US007591668B2

(12) United States Patent
Nakamura

(10) Patent No.: US 7,591,668 B2
(45) Date of Patent: Sep. 22, 2009

(54) CONNECTOR AND CONNECTOR ASSEMBLY

(75) Inventor: Hideto Nakamura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/183,272

(22) Filed: Jul. 31, 2008

(65) Prior Publication Data

US 2009/0035980 A1 Feb. 5, 2009

(30) Foreign Application Priority Data

Aug. 1, 2007 (JP) ..... 2007-200569
Aug. 10, 2007 (JP) ..... 2007-209429

(51) Int. Cl.
*H01R 3/00* (2006.01)

(52) U.S. Cl. ..... 439/489

(58) Field of Classification Search ..... 439/352, 439/357, 358, 489, 488
See application file for complete search history.

(56) References Cited

U.S. PATENT DOCUMENTS 4,902,244 A * 2/1990 Endo et al. ..... 439/489
5,120,255 A * 6/1992 Kouda et al. ..... 439/489
5,203,718 A * 4/1993 Chishima ..... 439/489
5,647,757 A 7/1997 Chrysostomou
6,068,507 A 5/2000 Popa
6,126,480 A * 10/2000 Kawase et al. ..... 439/489
6,383,009 B2 * 5/2002 Kawase et al. ..... 439/352
6,659,811 B2 * 12/2003 Okamoto et al. ..... 439/752
6,688,907 B2 * 2/2004 Yamaoka et al. ..... 439/489
6,692,288 B2 * 2/2004 Nimura ..... 439/352
6,824,417 B1 11/2004 Nimura
7,059,902 B2 * 6/2006 Nakamura ..... 439/595
7,252,530 B2 * 8/2007 Shamoto ..... 439/352
7,399,195 B2 * 7/2008 Kim et al. ..... 439/352
2002/0160651 A1 10/2002 Endo et al.
2003/0087545 A1 * 5/2003 Nimura ..... 439/352
2004/0121640 A1 6/2004 Okamoto et al.
2007/0059969 A1 * 3/2007 Shamoto ..... 439/352
2008/0166913 A1 * 7/2008 Siebens et al. ..... 439/489

FOREIGN PATENT DOCUMENTS

EP 1775800 4/2007
JP 2006-253073 9/2006

* cited by examiner

*Primary Examiner*—T C Patel
*Assistant Examiner*—Harshad C Patel
(74) *Attorney, Agent, or Firm*—Gerald E Hespos; Anthony J. Casella

(57) ABSTRACT

A detector (60) is assembled with a lock arm (12) of a housing (10) to be movable between a standby position and a detection position. The detector (60) can move from the standby position to the detection position when the housing (10) is connected properly with a mating housing (90), and a movement thereof to the detection position is prevented when the housing (10) is connected partly with the mating housing (90). The detector (60) is formed with a window (69). A detecting main body (64) of the detector (60) is seen through the window (69) at the standby position, whereas an upper plate (24) of the lock arm (12) is seen therethrough at the detection position. The detector (60) is in a first color and the housing is in a second color different from the first color.

15 Claims, 20 Drawing Sheets

CONNECTOR AND CONNECTOR ASSEMBLY

BACKGROUND OF THE INVENTION

1. Field of the Invention

The invention relates to a connector and a connector assembly.

2. Description of the Related Art

U.S. Pat. No. 6,824,417 discloses a connector that has a female housing with a lock arm and a detector mounted on the lock arm. The detector is movable between a standby position and a detection position with respect to the female housing. A movement preventing means holds the detector at the standby position in the process of connecting the housing with a mating housing. However, the detector is freed from the movement preventing means and can move to the detection position as the housings are connected properly. Accordingly, the connected state of the two housings can be detected based on whether the detector can be moved.

The arrival of the above-described detector at the detection position is confirmed by seeing the position of the detector or hearing a locking sound given by the detector at the detection position. However, there are cases where the position of the detector cannot be confirmed clearly or the locking sound may be drowned out by noise at an operation site. Thus, there is a likelihood of forgetting to move the detector and, hence, impairing the connection detecting function of the connector.

Japanese Unexamined Patent Publication No. 2006-253073 discloses another connector with a connection detecting function. This connector has a first housing with a lock projection. A second housing is connectable with the first housing and includes a lock arm. A connection detector is provided in the second housing and is slidable between an initial position and a detection position in directions substantially parallel to a connecting direction of the two housings. A resilient piece is cantilevered from the connection detector and extends towards the detection position.

The resilient piece contacts the lock arm when the connection detector is at the initial position and prevents a sliding movement of the connection detector to the detection position. Additionally, the resilient piece is displaceable together with the lock arm. The lock arm interferes with the lock projection in the process of connecting the housings and is deformed resiliently in a direction intersecting the connecting direction of the two housings. The lock arm passes the lock projection when the two housings are connected properly. Thus, the lock arm restores resiliently and engages the lock projection to prevent separation of the two housings. Additionally, the resilient piece is disengaged from the lock arm by interference with the lock projection. Thus, the connection detector can slide to the detection position.

An external force could be exerted on the connection detector of the above-described connector to move the connection detector towards the detection position before the housings are connected. This force could resiliently curve an area between a base end of the resilient piece and a locking portion thereof that engages the lock arm. Excessive deformation of the resilient piece could disengage the resilient piece from the lock arm due to the resilient restoring force of the resilient piece. As a result, the connection detector can slide to the detection position even though the housings are not connected yet.

The invention was developed in view of the above situation and an object thereof is to improve overall operability of a connection function.

SUMMARY OF THE INVENTION

The invention relates to a connector with a housing capable of accommodating at least one terminal fitting. At least one detector is assembled with the housing and can move from a standby position to a detection position if the housing is connected properly with a mating housing. However, the detector is prevented from moving to the detection position if the housing is connected only partly with the mating housing. The detector is has at least one opening and a background color seen through the opening differs when the detector is at the standby position than when the detector is at the detection position. Thus, the arrival of the detector at the detection position can be confirmed clearly. As a result, an operator will not forget to move the detector, and the reliability of a connection detecting function is improved.

A part of the detector may be seen through the opening when the detector is at the standby position and a part of the housing may be seen through the opening when the detector is at the detection position. The color in the opening and the color of a part surrounding opening can be the same at the standby position. Thus, an operator knows the arrival of the detector at the detection position when the background color seen through the opening becomes different from the color of the surrounding part, and the operator need not remember the specific background colors.

The housing preferably includes a lock arm for holding a connected state with the mating housing, and a corresponding part of the lock arm can be seen through the opening when the detector is at the detection position. Thus, the condition of the corresponding part of the lock arm also can be confirmed.

The detector preferably is a first color and the housing is a color different from the first color. Thus, it is not necessary to color-separate one part and production is easier.

A resilient piece preferably extends from the detector towards the detection position. The resilient piece contacts the lock arm to prevent a sliding movement of the detector to the detection position and is engaged with the lock arm for displacement together with the lock arm in a state where the detector is at the initial position. The lock arm interferes with a lock projection of the mating housing in a connecting process of the housing with the mating housing and deforms resiliently in a direction intersecting the connecting direction of the two housings. The lock arm passes the lock projection when the housings are connected properly and resiliently restores to engage the lock projection in a manner to prevent separation of the housings. The resilient piece is disengaged from the lock arm by interference with the lock projection so that the detector can move to the detection position. Accordingly, the detector is prevented from moving from an initial position to a detection position in a state where the housings are not yet connected, thereby improving operability.

An external force could be exerted on the connection detector to move the connection detector towards the detection position before the housings are connected. This external force could curve or otherwise deform the resilient piece so that the resilient piece contacts the restriction before being disengaged from the lock arm to prevent any further curved deformation of the resilient piece. Thus, the resilient piece cannot curve sufficiently to disengage from the lock arm. Consequently, the connection detector cannot move from the initial position to the detection position before the housings are connected.

A restriction preferably is provided to prevent an excessive curved deformation of the resilient piece towards a side opposite to the lock when the resilient piece is engaged with the lock arm and when the connection detector is at the initial position.

The maximum curved deformation of the resilient piece is between the base end of the resilient piece and the lock that engages the lock arm. Thus, the restriction is formed in this area where maximum deformation will occur, and hence can prevent excessive deformation of the resilient piece.

The resilient piece interferes with the lock projection when the housings are connected properly and the connection detector is at the initial position. Thus, the resilient piece inclines and displaces towards the restriction. Displacement of the resilient piece is maximal at its extending end. Thus, the restriction is not formed at the extending end of the resilient piece, and there is no likelihood of hindering displacement of the resilient piece due to interference of the extending end of the resilient piece with the restriction.

An arcuate or tapered contact preferably is formed at an end edge of the restriction closest to the extending end of the resilient piece. The extending end of the resilient piece engages the contact end edge of the restriction when the resilient piece is displaced to approach the restriction. This contact and the resilient piece could deform if the contact was an angular edge. However, the contact is arcuate or tapered and the resilient piece will not deform.

The restriction preferably is integral or unitary to the connection detector. Since the restriction is formed on the connection detector as a formation base of the resilient piece, there is no likelihood of disrupting the positional relationship of the resilient piece and the restriction.

The connection detector preferably includes two side walls at opposite sides of the resilient piece. The restriction connects the side walls and is aligned angularly to the side walls. Thus, the deflection strength of the restriction is higher than if the restriction is a single plate, and curved deformation of the resilient piece is restricted reliably.

The invention also relates to a connector assembly comprising the above described connector and a mating connector connectable therewith.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
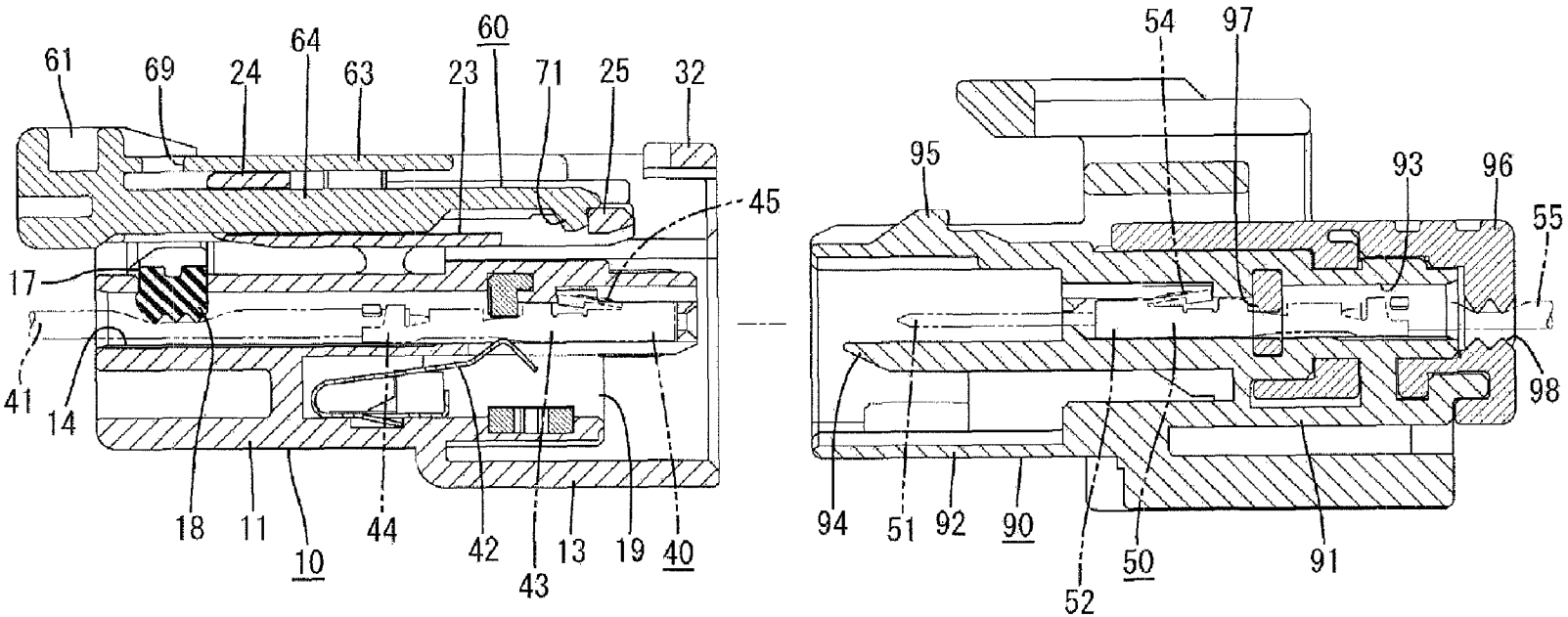
FIG. 1 is a side view in section showing a state before two housings are connected in a first embodiment of the invention.

A first embodiment of the invention is described with reference to FIGS. 1 to 10. A connector of this embodiment is provided with a housing 10, one or more female terminal fittings 40 and a detector 60. The housing 10 is connectable with a mating housing 90 and the detector 60 is movable between a standby position SP and a detection position DP with respect to the housing 10. In the following description, ends of the housings 10, 90 to be connected are referred to as front ends concerning forward and backward directions.

The male housing 90 is made e.g. of synthetic resin and includes a terminal accommodating portion 91 for accommodating male terminal fittings 50 and a tubular receptacle 92 that projects forward from the front of the terminal accommodating portion 91. Cavities 93 are formed in the terminal accommodating portion 91 and accommodate male terminal fittings 50. Tabs 51 of the male terminal fittings 50 project forward from the front surface of the cavities 93 and into the receptacle 92. A releasing piece 94 projects forward from the back of the receptacle 92 and a lock 95 projects from the upper surface of the receptacle 92. A retainer 96 is mounted in the terminal accommodating portion 91 for retaining the male terminal fittings 50. The retainer 96 includes terminal locks 97 for locking boxes 52 of the male terminal fittings 50, and substantially sawtooth-shaped projections 98 for biting in the insulation coatings of wires 55 connected with the male terminal fittings 50. The male terminal fittings 50 are retained in the cavities 93 primarily by the engagement of locking lances 54 with the inner walls of the cavities 94. The locking lances 54 are formed in the boxes 52 by cutting and bending. Alternatively or additionally, the male terminal fittings 50 may be retained in the respective cavities 93 by locks (not shown) provided thereon.

Figure 9:
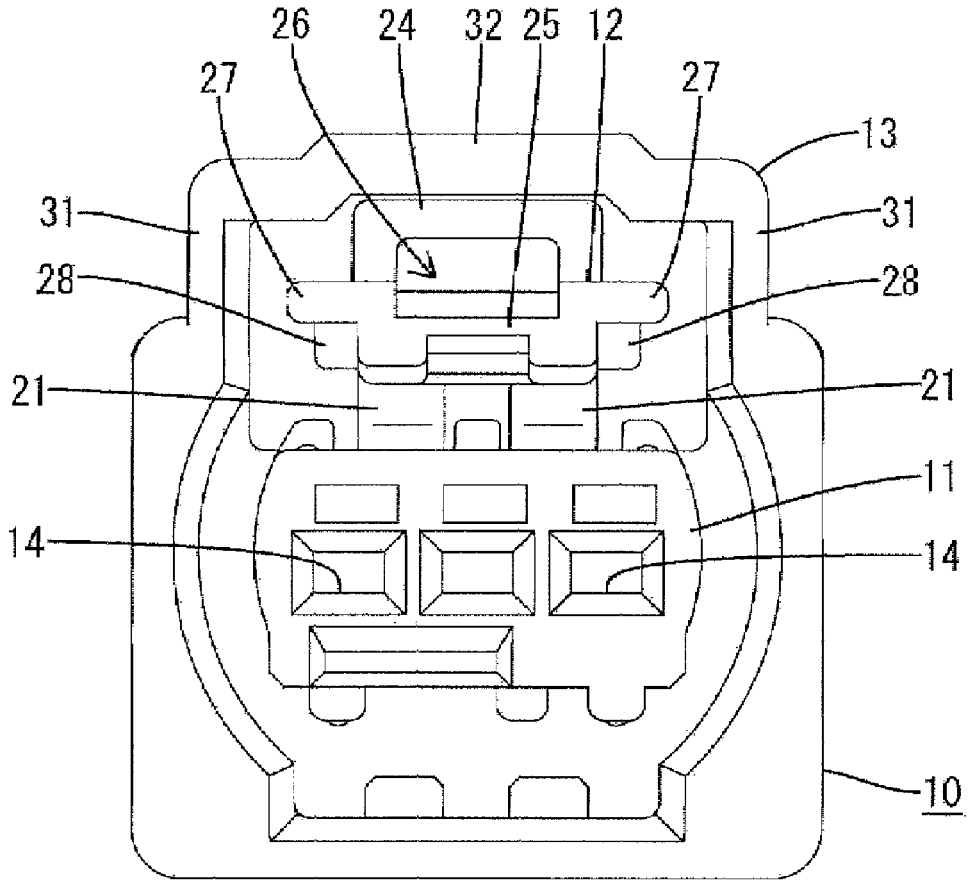
FIG. 9 is a front view of the housing.
Figure 10:
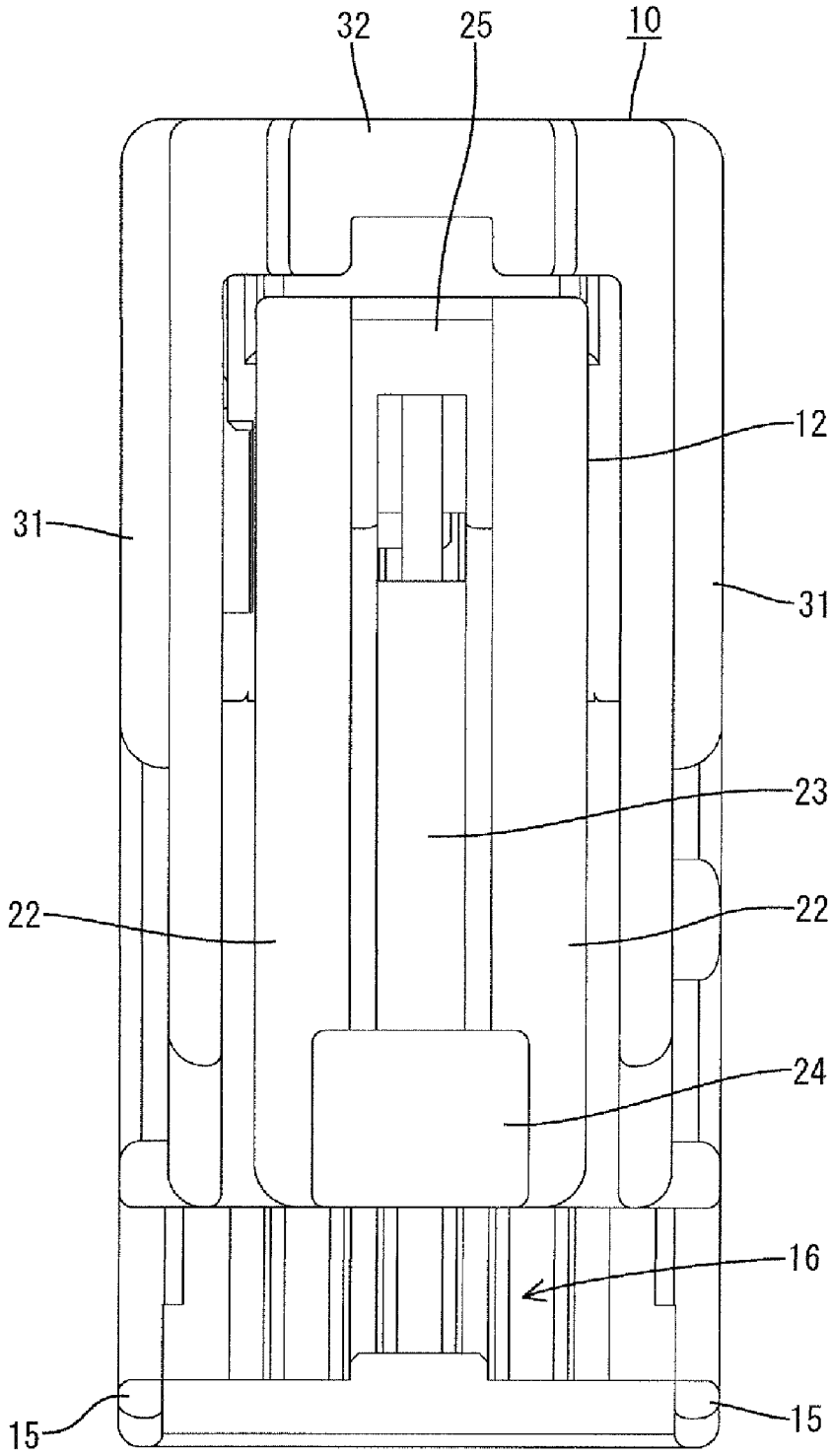
FIG. 10 is a plan view of the housing.

The housing 10 is made e.g. of synthetic resin and includes a flat block-shaped housing main body 11. A lock arm 12 is provided on the upper surface of the housing main body 11 and a fitting 13 surrounds the housing main body 11, as shown in FIG. 9. Cavities 14 are arranged in a lateral row in the housing main body 11 and accommodate female terminal fittings 40. As shown in FIG. 10, left and right receiving portions 15 project from the rear end of the housing main body 11. Further, a communication space 16 penetrates a rear end of the housing main body 11 and provides communication between the upper surface of the housing main body 11 and the cavities 14. A wire holder 17 can be fit in this communication space 16. As shown in FIG. 1, the wire holder 17 includes substantially sawtooth-shaped or pointed projections 18 for engaging the insulation coatings of wires 41 to prevent movements of the wires 41 in forward and backward directions.

An accommodating chamber 19 for a shorting terminal 42 is formed in the front of the housing main body 11 and provides communication between at least two adjacent cavities 14. The accommodating chamber 19 also opens in a side surface of the fitting 13, and the shorting terminal 42 can be mounted through this side opening. The shorting terminal 42 contacts the female terminal fittings 40 in at least two of the cavities 14 from below to short the terminal fittings 40 (see FIG. 1) until connection of the two housings 10, 90 is completed. The releasing piece 94 of the receptacle 92 presses the shorting terminal 42 away from the terminal fittings 40 to release the shorted state when the housings 10, 90 are connected properly (see FIG. 3).

The lock arm 12 has left and right legs 21 that stand up from the upper surface of the housing main body 11. Left and right arms 22 extend forward and back from the upper ends of the legs 21 and a lower plate 23 couples the bottom end edges of the arms 22. A substantially rectangular upper plate 24 couples the upper end edges of the arms 22 and a lock main body 25 couples the front ends of the arms 22. The lock arm 12 is pivotally displaceable up and down like a seesaw in a direction intersecting a connecting direction of the two housings 10, 90 with the legs 21 as supports. A formation area of the lower plate 23 in forward and backward directions extends from a position behind the lock main body 25 to the rear ends of the arms 22, and the upper plate 24 is arranged at the rear ends of the arms 22. The lower and upper plates 23 and 24 are thin and are arranged substantially horizontally in different levels. A mount space 26 is defined between the upper plate 24 and the lower plate 23 and between the two arms 22.

Left and right guide ribs 27 project at opposite lateral edges of the arms 22 extend substantially in forward and backward directions. Left and right retaining projections 28 project at the opposite lateral edges of the lower surfaces. The lower surfaces of the guide ribs 27 and the upper surfaces of the retaining projections 28 are connected unitarily.

Left and right side walls 31 stand up from the fitting 13 at opposite sides of the lock arm 12. A coupling wall 32 couples the front ends of the upper edges of the opposite side walls 31.

The outer surfaces of the housing 10 including the lock arm 12 are formed entirely in a second color, specifically in a bright color, such as yellow, and the entire external appearance thereof is seen uniformly in the bright color before the detector 60 is assembled.

Each female terminal fitting 40 is narrow and long in forward and backward directions. A substantially box-shaped connecting portion 43 is formed at the front part of the female terminal fitting 40 and a wire crimping portion 44 with at least one open barrel is formed at the rear part of the female terminal fitting 40. A locking lance 45 is formed in the connecting portion 43 by cutting and bending. The female terminal fitting 40 is inserted into the cavity 14 from behind and is retained in the cavity 14 by the resilient engagement of the locking lance 45 with the inner wall of the cavity 14. Alternatively or additionally, the female terminal fitting 40 may be retained in the cavity 14 by a locking portion provided in the cavity 14.

Figure 7:
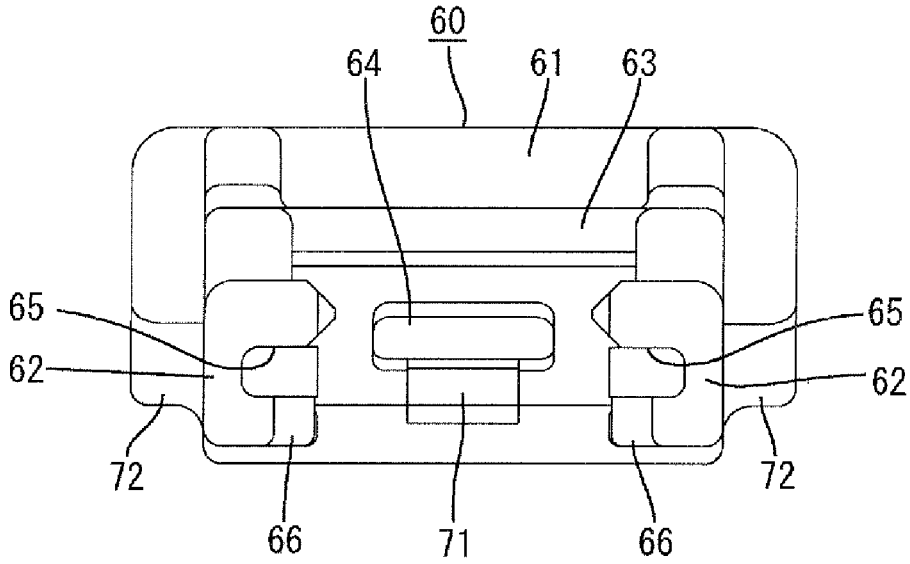
FIG. 7 is a front view of the detector.
Figure 8:
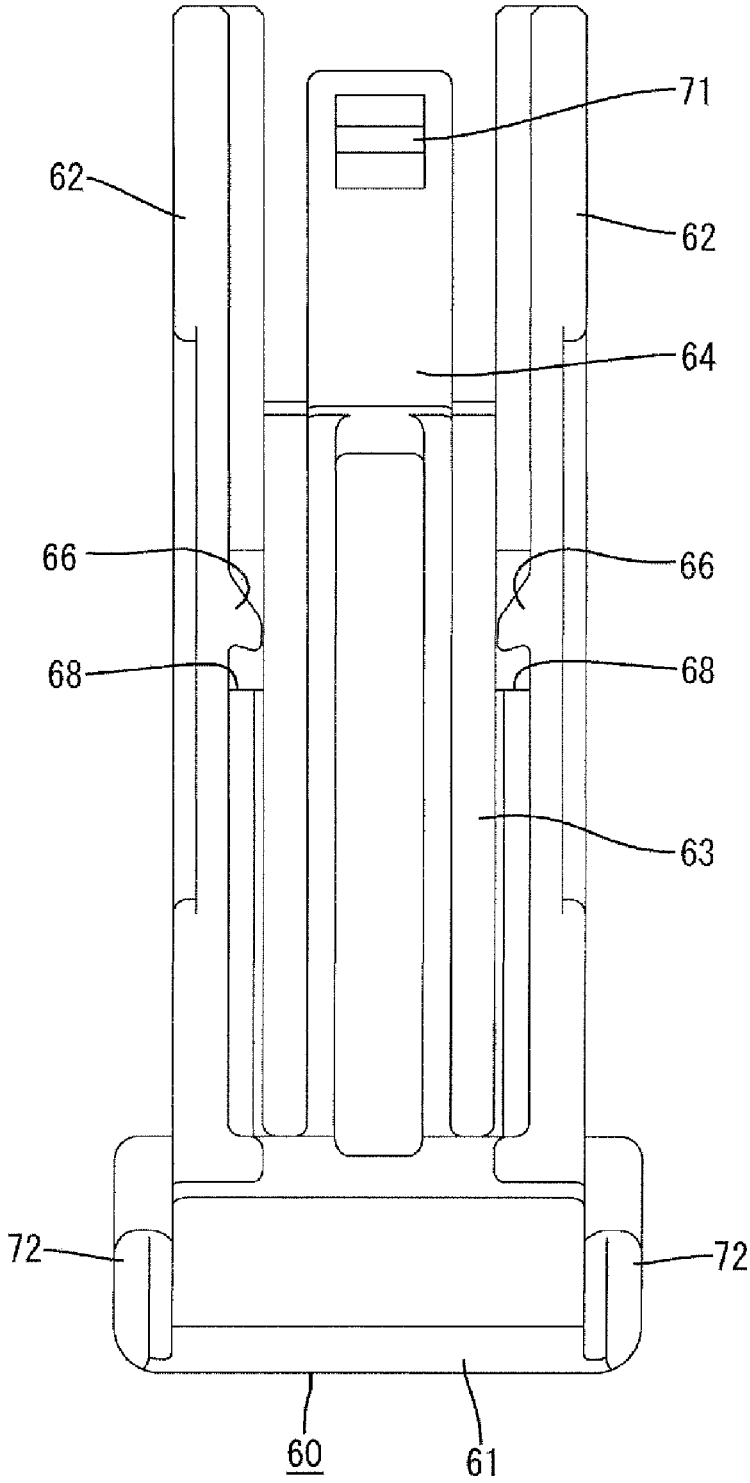
FIG. 8 is a bottom view of the detector.

The detector 60 is made e.g. of synthetic resin and includes a substantially block-shaped operable portion 61 near the rear end. Left and right guide arms 62 are cantilevered forward from the opposite sides of the operable portion 61 and a cover 63 couples the upper end edges of the guide arms 62. A detecting main body 64 is cantilevered forward from the operable portion 61 at a position below the cover 63 and between the two guide arms 62, as shown in FIG. 8. As shown in FIG. 7, guide grooves 65 are formed in the inner surfaces of the guide arms 62 and extend in forward and backward directions. The guide grooves 65 are arranged so that openings thereof face inwardly. Left and right retaining projections 66 are provided on the inner surfaces of the guide arms 62 below the guide grooves 65.

Figure 4:
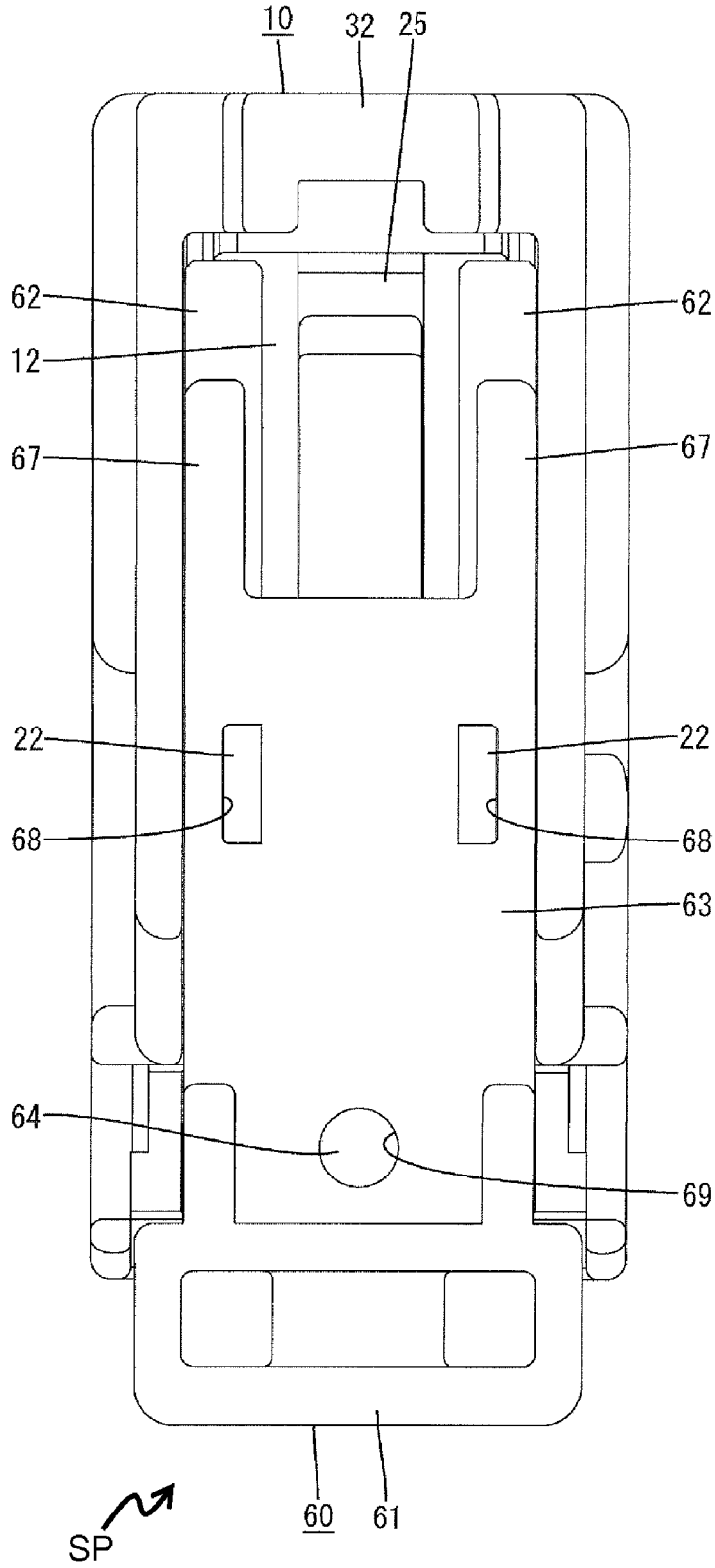
FIG. 4 is a plan view showing a state where the detector is held at a standby position with respect to a lock arm.

As shown in FIG. 4, the cover 63 is a substantially flat plate covering substantially the rear half of the housing main body 11. Left and right contact pieces 67 project forward from the front end edge of the cover 63. Left and right through holes 68 are formed at positions near the opposite lateral edges of the cover 63. The through holes 68 of the cover 63 are rectangular and are longer in forward and backward directions. The corresponding retaining projections 66 can be seen through the through holes 68 in an isolated state before being assembled. The cover 63 also is formed with a window 69 at a substantially widthwise center position near the rear end edge. The window 69 of the cover 63 is a substantially round hole. The upper surface of the detecting main body 64 can be seen through the window 69 when the detector 60 is in a standby position SP and the upper surface of the upper plate 24 can be seen through the window 69 when the detector 60 is at the detection position DP.

The detecting main body 64 is a narrow plate that is long in forward and backward directions and is resiliently deformable up and down. A contact 71 projects down at the front end of the detecting main body 64. A front end portion of the detecting main body 64 is thinner than a base end thereof that is connected with the operable portion 61 to enable smooth deformations of the front end and to increase the strength of the base end. The bottom end of the operable portion 61 is slightly below the lower surface of the detecting main body 64, and the front end edge of the bottom end of the operable portion 61 defines connection detecting portions 72.

The outer surfaces of the detector 60 preferably are entirely in a first color different from the second color, specifically in a darker color such as blue, so that the entire external appearance thereof is seen uniformly in the first color before being assembled with the lock arm 12.

The detector 60 is assembled with the lock arm 12 of the housing 10 from behind so that the detecting main body 64 enters the mount space 26. The guide ribs 27 engage the guide grooves 65 in this assembling process so that the detector 60 is slid forward with respect to the lock arm 12 and the guide arms 62 are deformed resiliently out in the width direction by the interference of the retaining projections 28, 66. The retaining projections 66 of the detector 60 engage the retaining projections 28 of the lock arm 12 from the front when the detector 60 is assembled to the standby position SP with respect to the lock arm 12 for retaining the detector 60. Additionally, the contact projection 71 engages the lock main body 25 from behind to prevent the detector 60 from moving any farther forward. These engaging actions hold the detector 60 at the standby position SP. At this time, the detecting main body 64 is held between the lower and upper plates 23 and 24 and between the left and right arms 22. Furthermore, the upper plate 24 is held between the detecting main body 64 and the cover 63. Thus, the detector 60 is united with the lock arm 12 and can be displaced like a seesaw. A sliding space 39 for the upper plate 24 is defined between the lower surface of the cover 63 and the upper surface of the detecting main body 64, and a dimension of the sliding space 39 is substantially equal to or slightly larger than the thickness of the upper plate 24. The lock arm 12 and the detector 60 displace in the unlocking direction when the operable portion 61 is pressed down.

The detector 60 is held at the standby position SP with respect to the lock arm 12. In this state, as shown in FIGS. 1 and 4, the operable portion 61 projects more backward than the rear surface of the housing main body 11. The upper surfaces of the arms 22 can be seen through the through holes 68 and the upper surface of the detecting main body 64 can be seen through the window 69 when the detector 60 is viewed from above. The detector 60 is entirely in the first color (preferably blue). Thus, a background color seen through the window 69 is the same first color (blue) as a peripheral part of the window 69. On the other hand, a background color seen through the holes 68 is the second color (preferably yellow) as the color of the housing main body 11 and remains the second color (yellow) even when the detector 60 is moved.

Figure 2:
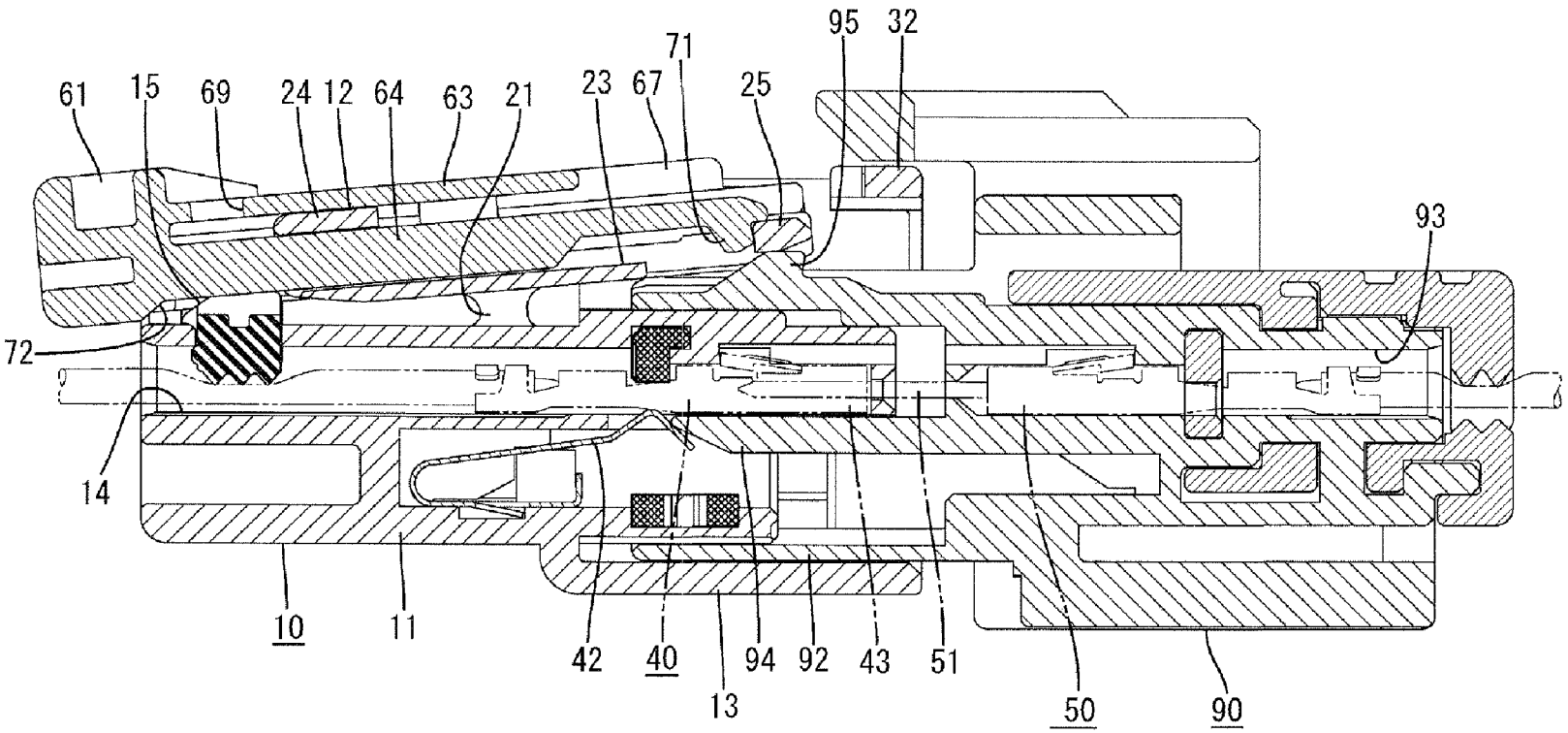
FIG. 2 is a side view in section showing a state in the process of connecting the two housings.

The receptacle 92 of the mating housing 90 is inserted between the housing main body 11 and the fitting 13 when the housing 10 is connected with the mating housing 90. In this connecting process, the lock main body 25 of the lock arm 12 moves onto the lock 95 of the mating housing 90, as shown in FIG. 2. Thus, the lock arm 12 and the detector 60 are displaced to extend obliquely up towards the front and the connection detecting portions 72 of the detector 60 are displaced in to face the receiving portions 15 of the housing main body 11 from behind. The connecting operation of the two housings 10, 90 could be left incomplete (e.g. halfway), and then an attempt could made to move the detector 60 forward toward the detection position DP. However, the connection detecting portions 72 will contact the receiving portions 15 to prevent a forward movement of the detector 60. The contact projection 71 is kept engaged with the lock main body 25 to prevent the forward movement of the detector 60.

The lock main body 25 passes the lock 95 when the two housings 10, 90 are connected properly. Thus, the lock arm 12 returns resiliently towards its free state to engage the lock main body 25 with the lock 95 and to hold the housings 10, 90 together. At this time, the lower surface of the contact projection 71 contacts the upper surface of the lock 95 so that the detecting main body 64 is deformed up and out relative to the lock arm 12. Further, the operable portion 61 of the detector 60 is displaced up and out together with the lock arm 12, thereby disengaging the connection detecting portions 72 from the receiving portions 15. As a result, the contact projection 71 and the lock main body 25 are disengaged to permit a movement of the detector 60 to the detection position DP. In this state, the background color seen through the window 69 remains the second color (yellow) since the position of the detector 60 relative to the lock arm 12 continues to be the standby position SP.

Figure 3:
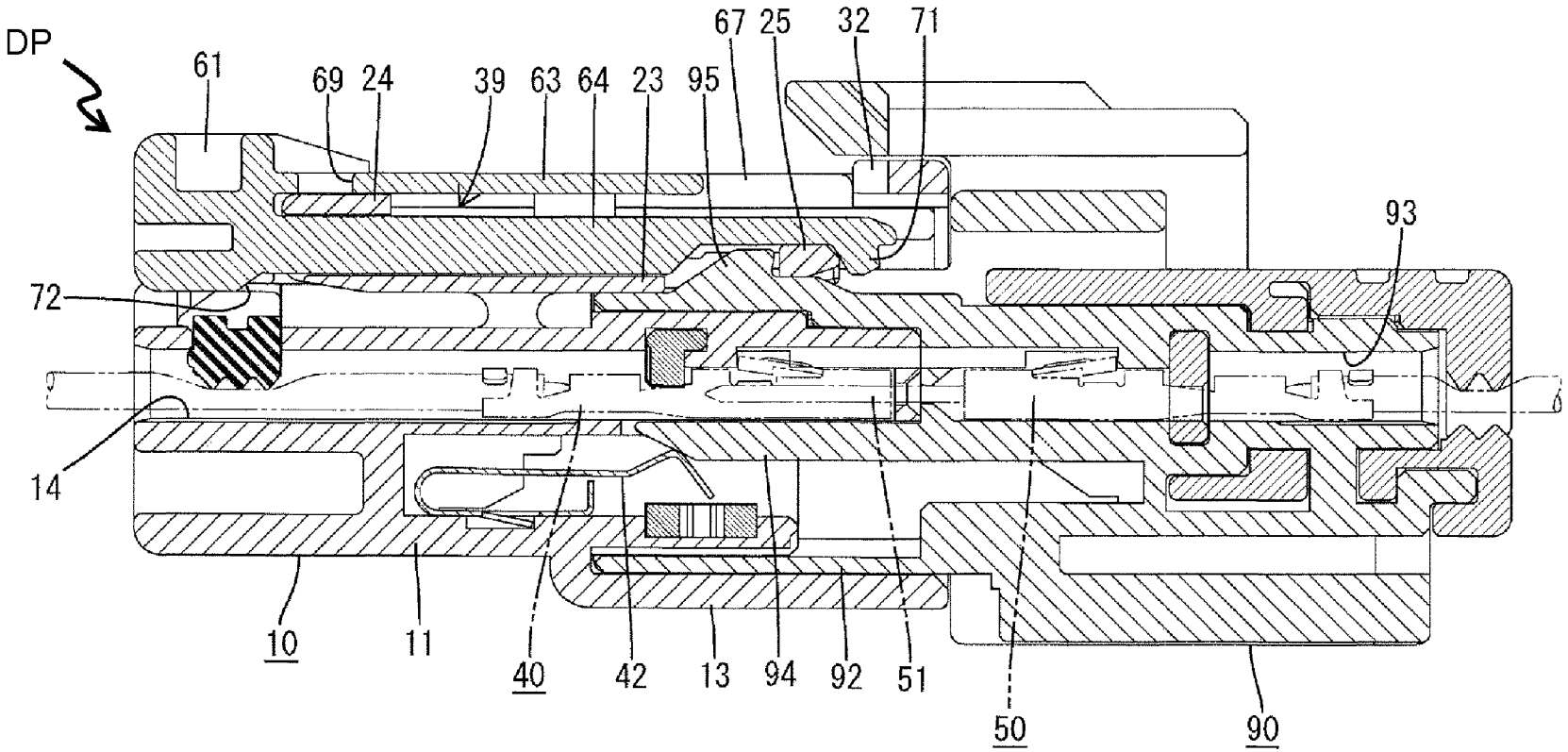
FIG. 3 is a side view in section showing a state where the two housings are properly connected to bring a detector to a detection position.
Figure 5:
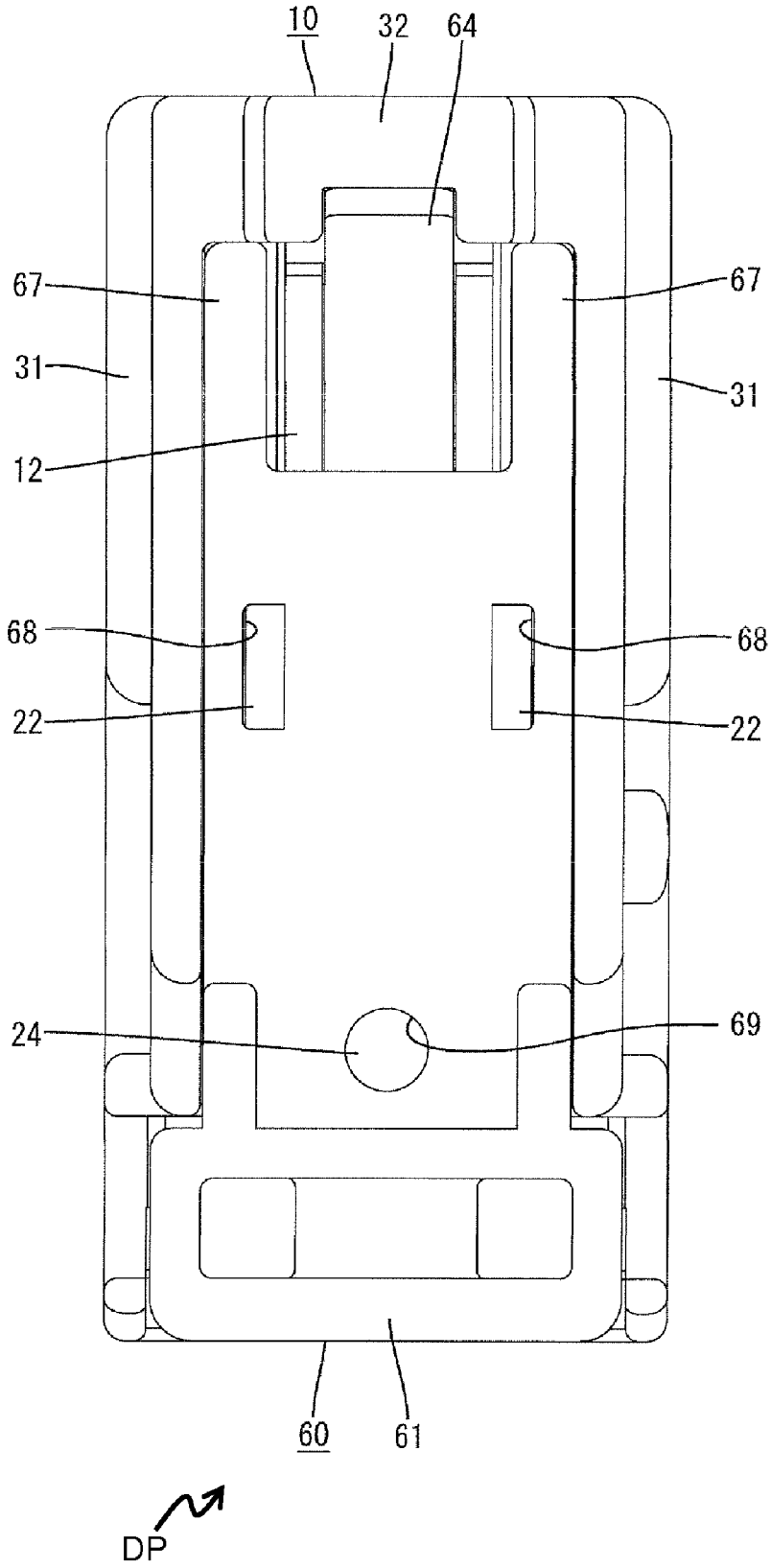
FIG. 5 is a plan view showing a state where the detector is held at the detection position with respect to the lock arm.
Figure 6:
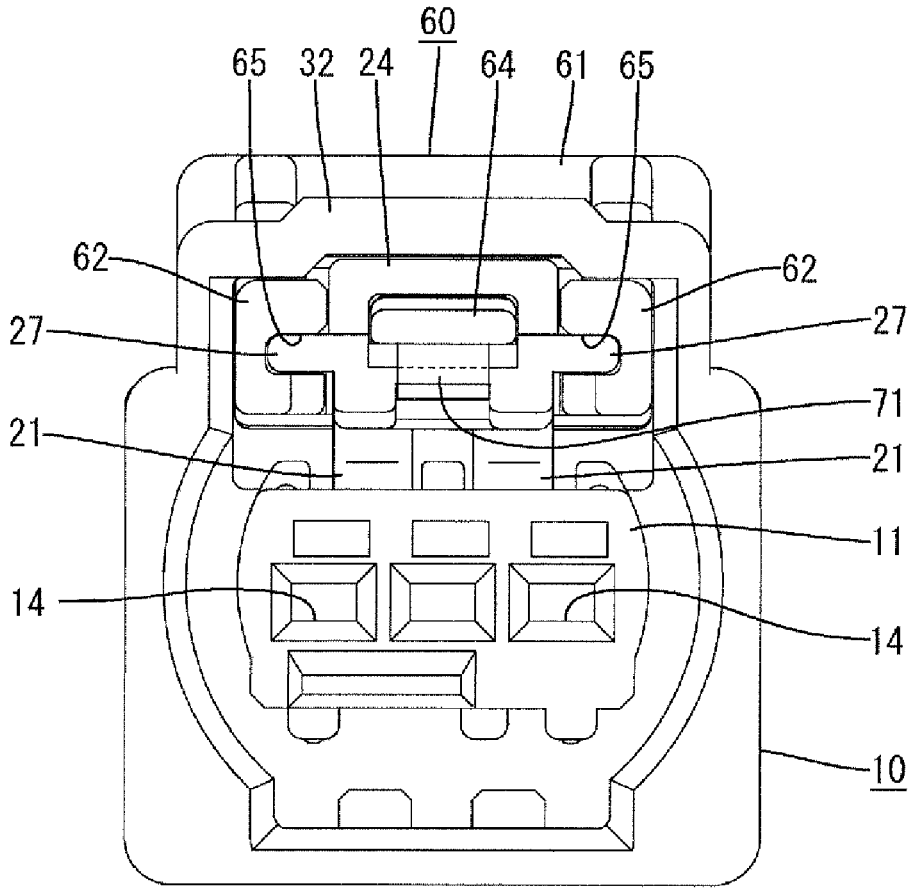
FIG. 6 is a front view showing the state where the detector is held at the detection position with respect to the lock arm.

The detector 60 then is slid towards the detection position DP with respect to the lock arm 12. In this sliding process, the contact projection 71 passes the lock 95 and the lock main body 25. Thus, the detecting main body 64 restores resiliently. As this sliding movement ends, the contact projection 71 engages the lock main body 25 from the front, as shown in FIG. 6. The front ends of the contact pieces 67 then contact the coupling wall 32 from behind to prevent further forward movement of the detector 60. In this way, the detector 60 is held at the detection position DP and cannot move forward and back with respect to the lock arm 12, as shown in FIGS. 3 and 5. Further, front ends of both guide arms 62 slip under the coupling wall 32 and contact the lower surface of the coupling wall 32 to prevent upward displacement of the detector 60 and the lock arm 12 in the unlocking direction. Thus, the lock main body 25 and the lock 95 are kept reliably engaged to doubly lock the housings 10, 90. The rear end of the detector 60 at the detection position DP and the rear end of the housing main body 11 are aligned in forward and backward directions.

The upper plate 24 of the lock arm 12 is displaced back with respect to the detector 60 in the sliding space 39 between the detecting main body 64 and the cover 63 as the detector 60 is moved from the standby position SP to the detection position DP. Thus, the upper plate 24 of the lock arm 12 gradually appears in the window 69 immediately before the detector 60 reaches the detection position DP. The upper plate 24 appears in the entire window portion 69 as the detector 60 reaches the detection position DP. Accordingly, if an operator looks inside the window 69 in this state, the second color (yellow color) of the upper plate 24 (housing 10) can be seen through the window 69.

On the other hand, the upper plate 24 is located before the window 69 if the detector 60 is kept at the standby position SP. Therefore only the upper surface of the detecting main body 64 can be seen through the window 69 via the sliding space 39 and the background color seen through the window 69 is the same first color (blue color) as the peripheral part of the window 69. Accordingly, an operator judges that the detector 60 has not been moved if there is no change in the background color seen through the window 69, and, in this case, the detector 60 is pushed to the detection position DP anew.

The background color seen through the window 69 is a different color than the one seen at the standby position SP when the detector 60 is moved from the standby position SP to the detection position DP. Therefore the arrival of the detector 60 at the detection position DP is detected visually and clearly. As a result, an operator will not forget to move the detector 60, thereby improving the reliability of the connection detecting function of the connector.

The color in the window 69 when the detector is at the standby position SP is the color of the upper surface of the detecting main body 64 and the color outside the window 69 at the upper surface of the cover 63 is the same (e.g. blue). Thus, the operator need not remember the background colors seen through the window 69 at the standby position SP and at the detection position DP and can judge the arrival of the detector 60 at the detection position DP by the fact that the color (yellow in this embodiment) is different from that of the peripheral part of the window 69 has appeared in the window 69. Therefore, an erroneously confirming possibility of the operator decreases and the reliability of the connection detecting function is improved.

The detecting main body 64 of the lock arm 12 is seen through the window 69 at the detection position DP. Thus, a condition such as a defective state of the detecting main body 64 also can be confirmed. Therefore the quality of the lock arm 12 also can be improved.

The detector 60 preferably is entirely in the first color (blue) and the housing 10 preferably is entirely in the second color (yellow) different from the first color. Thus, there is no need to color-separate the upper plate 24 and the detecting main body 64 from surrounding parts, and production is easier.

The window 69 is at the easily detectable position of the detector 60 in the widthwise intermediate part of the outer or upper surface of the connector near the operable portion 61 and has an easily visible shape (looped opening). Thus, the visibility thereof is good.

The invention is not limited to the above described and illustrated embodiment. For example, the following embodiments are also embraced by the technical scope of the present invention.

It is sufficient that the background colors seen through the window are different at the standby position and at the detection position, and they can be any colors. Each background color may not necessarily be limited to a single color and may be a combination of colors. Of course, it is preferable to combine such colors that a color difference chromatically stands out between the standby position and the detection position.

The background other than the detecting main body may be seen through the window at the standby position, and the background other than the upper plate may be seen through window portion at the detection position.

The detector may be mounted on a movable part of the housing other than the lock arm, such as a lever in a lever-type connector.

The window may be a cutout at an end edge of the detector.

A plurality of windows may be formed in the detector.

A transparent or semitransparent filter may be mounted to cover the window to prevent external matter, such as dust, from entering the window.

A second embodiment of the invention is described with reference to FIGS. 11 to 21. A connector of this embodiment is provided with a first housing 110 having male terminal fittings 111 mounted therein and a second housing 120 having female terminal fittings 121 mounted therein. It should be noted that, in the following description, forward and backward directions are the same directions as those parallel to a connecting direction of the housings 110, 120.

The first housing 110 is made e.g. of synthetic resin and includes a tubular receptacle 112 projecting forward in the same direction as the connecting direction with the second housing 120. A lock 113 projects from the upper surface (outer surface) of the upper wall of the receptacle 112.

The second housing 120 is made unitarily e.g. of synthetic resin and has a block-shaped terminal holding portion 122 and a rectangular tubular fitting 123 that surrounds a front portion of the terminal holding portion 122. The female terminal fittings 121 are accommodated in the terminal holding portion 122. A lock arm 124 is formed unitarily on the upper surface of the terminal holding portion 122 and extends in forward and backward directions. The lock arm 124 includes left and right arms 125 that extend in forward and backward directions, a lock 126 that connects the front ends of the arms 125, a coupling plate 127 that couples the rear ends of the arms 125, legs 128 that project from substantially central positions of the lower surfaces of the arms 125, and a lower plate 129 that couples the bottom end edges of the arms 125 and is supported on the terminal holding portion 122 at the legs 128. The lock arm 124 is in a locking posture where the arms 125 extend forward and backward in directions substantially parallel to connecting and separating directions of the two housings 110, 120 and are in a free state where the lock arm is not resiliently displaced. However, the lock arm 124 is resiliently displaceable like a seesaw to an unlocking posture reached by displacing a front end of the lock arm 124 up substantially orthogonal to forward and backward directions with the legs 128 as supports. Guide ribs 130 are formed at the outer lateral edges of the arms 125 extend in the length direction of the arms 125. Stoppers 131 are formed on lower surfaces of the guide ribs 130. The lower plate 129 extends from the rear ends of the arms 125 to a position slightly behind the lock 126 and the front ends of the arms 125. There is an open space between the front end edge of the lower plate 129 and the lock 126 for receiving the lock projection 113. An upper wall 123A of the tubular fitting 123 is formed with an opening 123B by cutting away an area excluding the opposite left and right edges and a front edge, and the lock arm 124 is exposed upward through this opening 123B.

A connection detector 133 is mounted in the second housing 120 and is made unitarily e.g. of synthetic resin. The connection detector 133 has left and right long narrow side walls 134 that extend in forward and backward directions. An operable portion 135 couples the rear ends of the side walls 134, and a bar-shaped support 136 projects forward and parallel with the side walls 134 in a space between the opposite side walls 134. A resilient piece 137 extends farther forward from the front extending end of the support 136 and a restricting plate 138 couples the upper edges of the side walls 134.

Guide grooves 139 are formed in the inner side surfaces of the side walls 134 and extend substantially parallel to the lengthwise direction of the side walls 134. Retaining projections 140 project in from the inner side surfaces of the side walls 134 at substantially central positions in forward and backward directions. The resilient piece 137 has a smaller vertical thickness than the support 136. The upper surface of the resilient piece 137 is substantially flush with and continuous with the upper surface of the support 136 and the lower surface of the resilient piece 137 is above the lower surface of the support 136. A lock 141 is formed at the front end of the resilient piece 137 for engaging the lock 126 of the lock arm 124. The lock 141 has a projecting end 142 at the front extending end of the resilient piece 137, a touching portion 143 projecting down from a position slightly behind the projecting end 142, and a cut-away portion 144 at the lower surface of the projecting end 142 and the front surface of the touching portion 143. The resilient piece 137 is resiliently deformable to curve up and out between a rear base end substantially continuous with the front end of the support 136 and the lock 141 and resiliently displaceable so that the lock 141 side is displaced up and out with the base end as a support. Further, the front end of the resilient piece 137 is located behind the front ends of the side walls 134.

The restriction 138 is connected with the upper end edges of the side walls 134 at right angles and extends continuously in forward and backward directions from the rear ends of the side walls 134 (front end of the operable portion 135) to a position slightly behind the front ends of the side walls 134. The front end of the restriction 138 is slightly behind the front projecting end 142 of the lock 141 of the resilient piece 137 and is at substantially the same position as the touching portion 143 in forward and backward directions. In other words, a formation range of the restriction 138 in forward and backward directions includes an area corresponding to at least a lengthwise middle part of the resilient piece 137 in a curvable area from the base end of the resilient piece 137 to the lock 141, i.e. is not an area not corresponding to the extending end or the lock 141 of the resilient piece 137. Accordingly, the front end of the resilient piece 137 that includes the projecting end 142 and the substantially front half of the touching portion 143 of the lock 141 projects more forward than the front end of the restriction 138. Most of the resilient piece 137, excluding the front end, is covered by the restriction 138 from above. Thus, the resilient piece 137 is protected from interference of external matter by the restriction 138. Further, a space for permitting upward resilient displacement and curved deformation of the resilient piece 137 is defined between the lower surface of the restriction 138 and the upper surface of the resilient piece 137. An arcuate contact portion 145 is formed at the lower edge of the front end of the restriction 138 at the same side as the extending end of the resilient piece 137. The restriction 138 also is formed with a single window 169 at a widthwise intermediate position near the rear end edge. The window 169 of the restriction 138 is a round hole. When the detector 133 is in a state before being assembled or in the standby position SP, the upper surface of the support 136 of the detector 133 can be seen through the window 169. When the detector 133 is at the detection position DP the upper surface of the coupling 127 of the housing 110 can be seen through the window 169.

Figure 16:
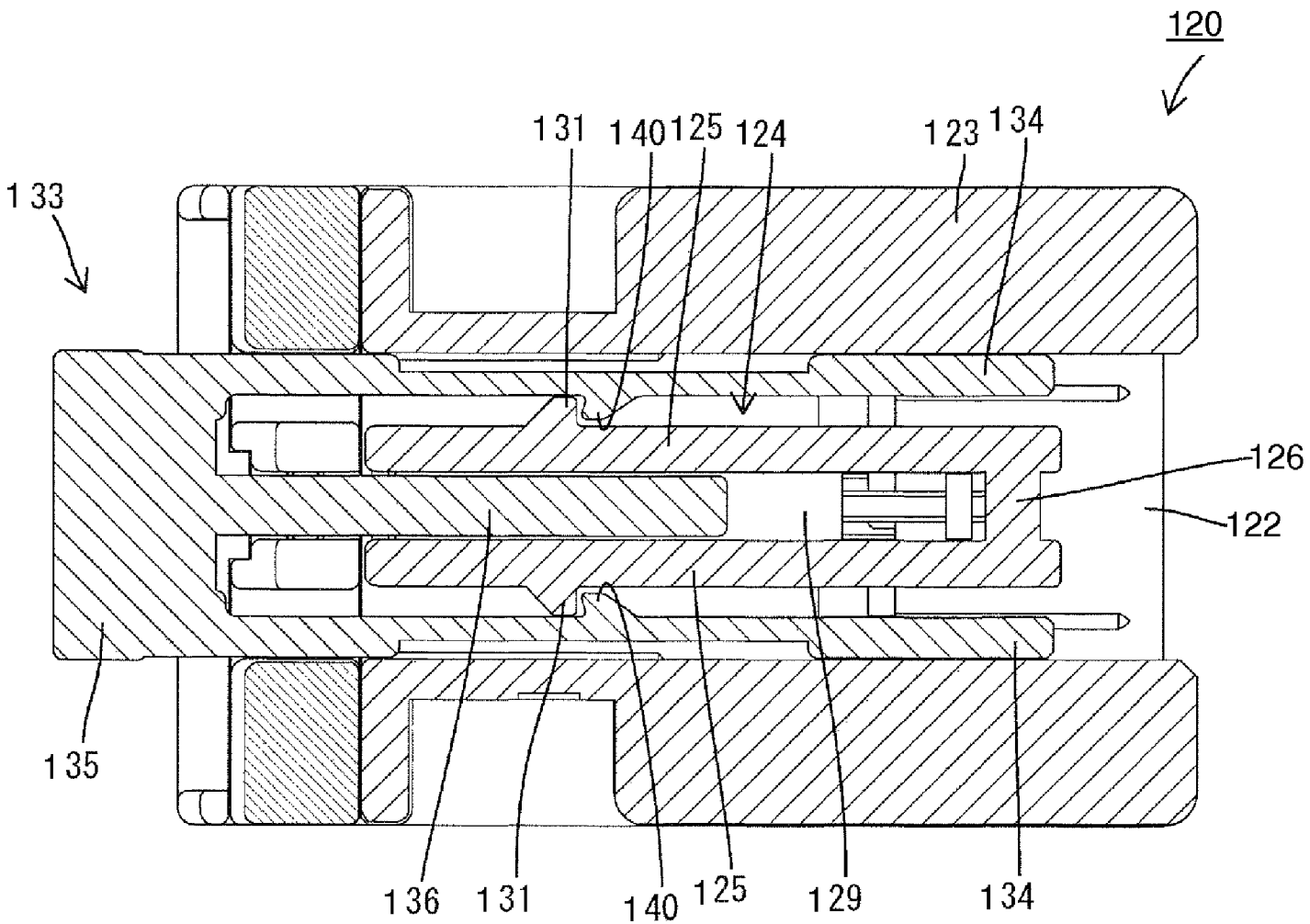
FIG. 16 is a horizontal section showing a state where the connection detector is held at the initial position.
Figure 17:
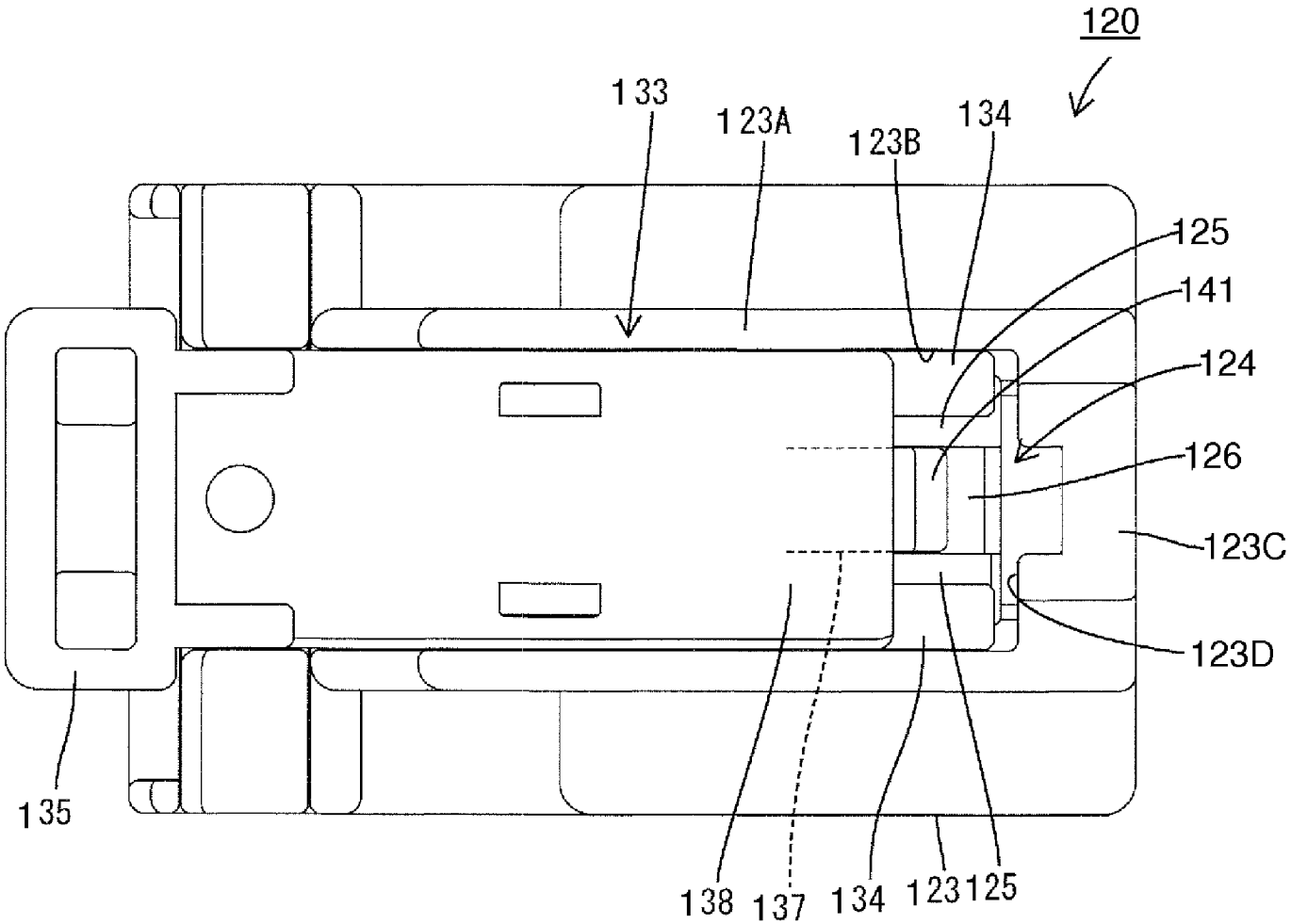
FIG. 17 is a plan view of the second housing.
Figure 18:
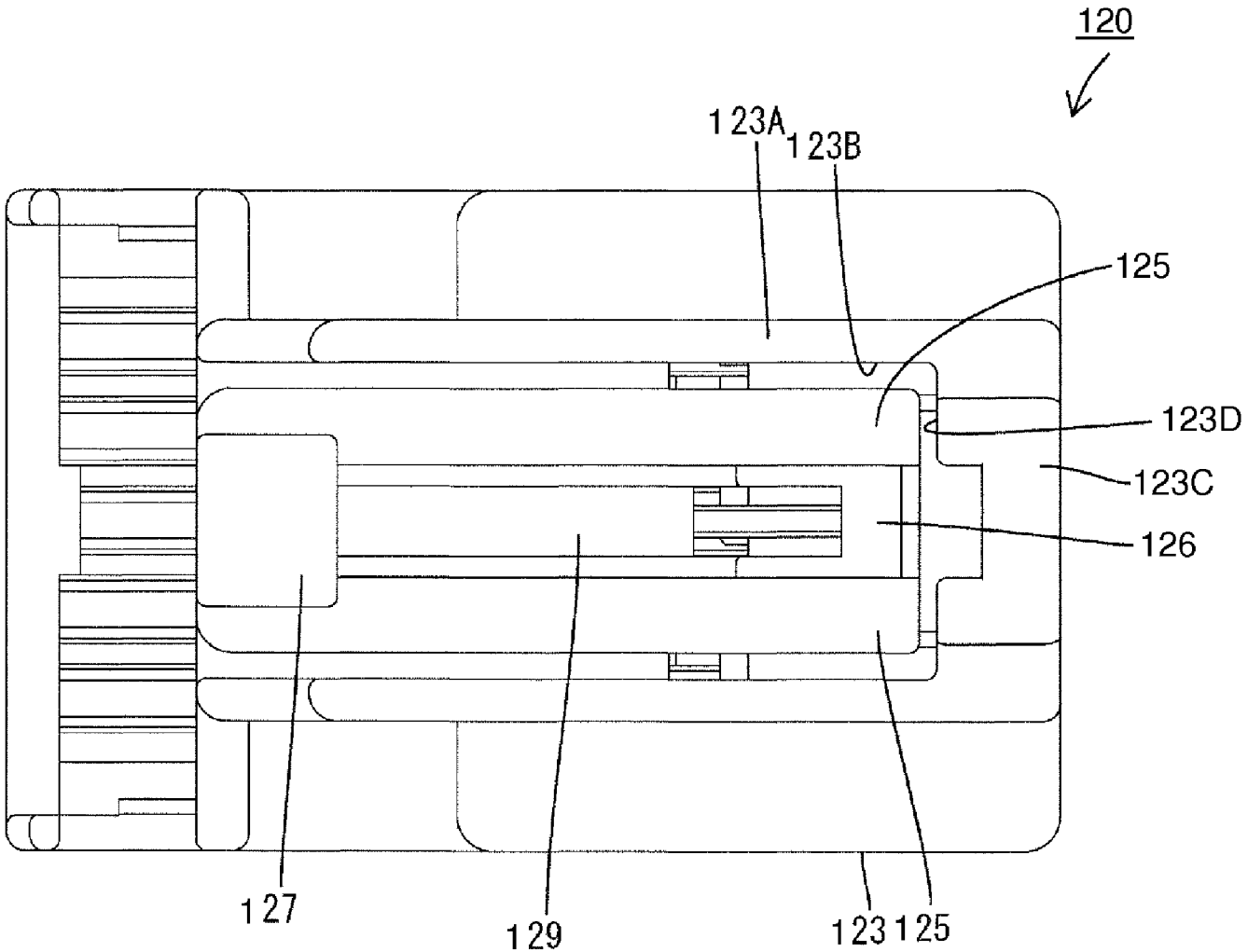
FIG. 18 is a plan view showing a state where the connection detecting member is detached from the second housing.
Figure 19:
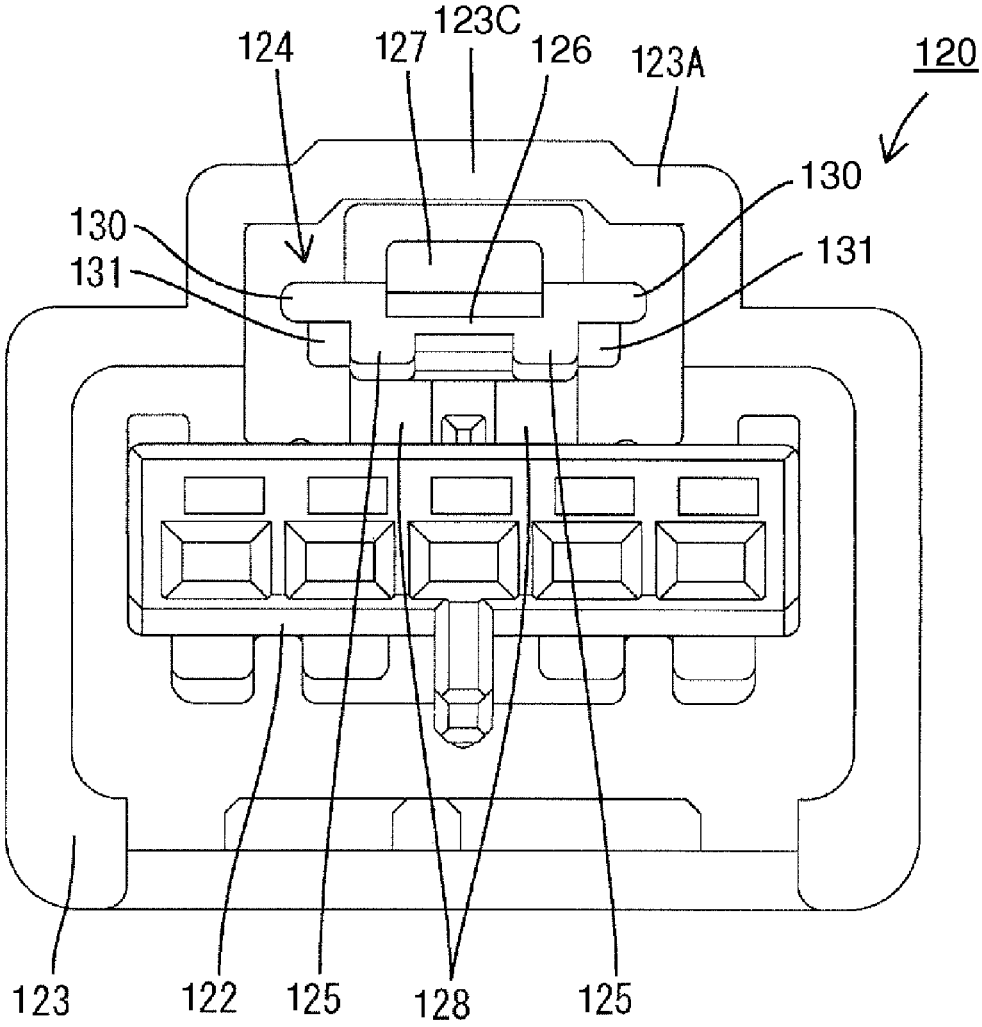
FIG. 19 is a front view showing a state where the connection detector is detached from the second housing.
Figure 20:
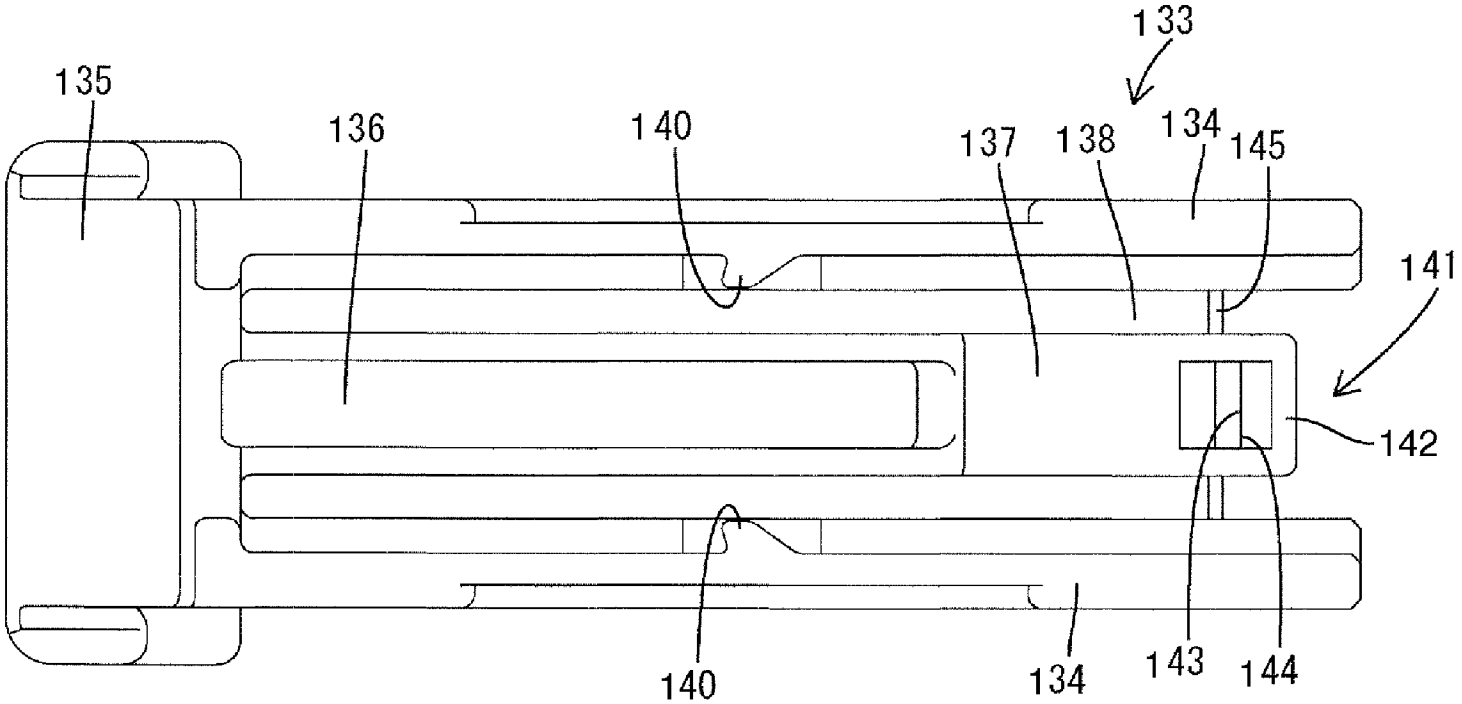
FIG. 20 is a bottom view of the connection detector.
Figure 21:
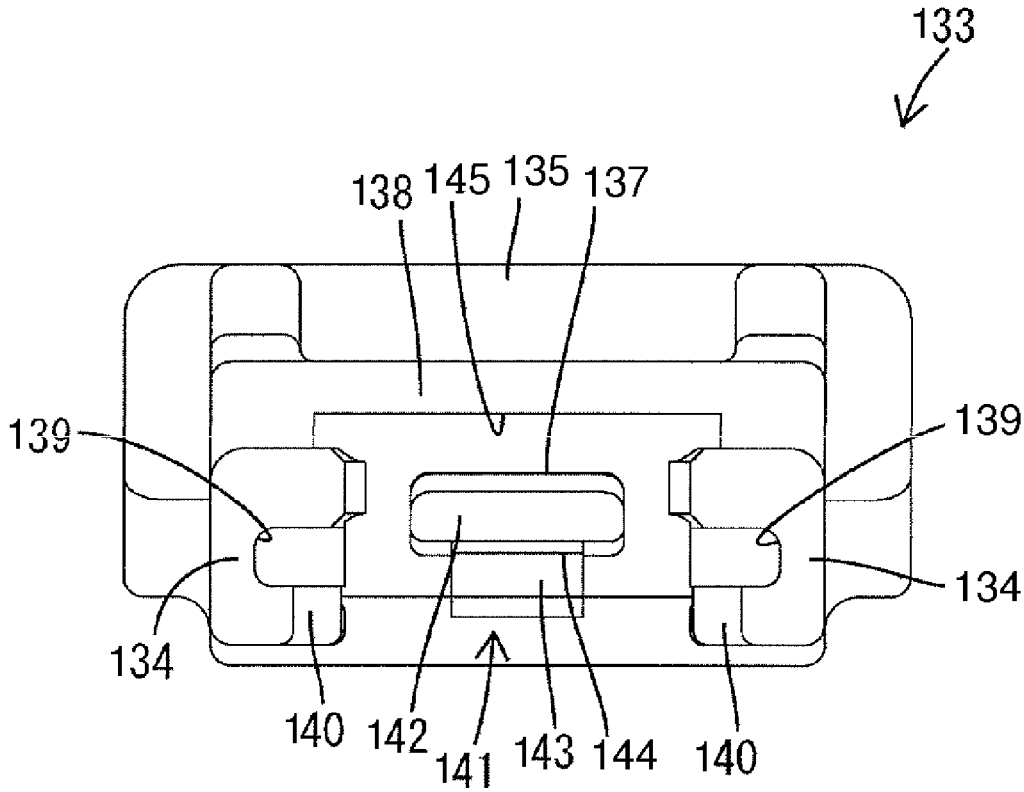
FIG. 21 is a front view of the connection detector.

The connection detector 133 is assembled with the lock arm 124 from behind by being slid with the guide grooves 139 engaged with the guide ribs 130. The retaining projections 140 pass the stoppers 131 and engage the stoppers 131 from the front when the connection detector 133 reaches the stand-by position SP, as shown in FIG. 16. Thus, a backward movement of the connection detector 133 is prevented, and the touching portions 143 at the front end of the resilient piece 137 engage the lock 126 from behind to prevent further forward movement of the connection detector 133. As a result, the connection detector 133 is held at the initial or stand-by position SP (see FIGS. 12 and 17). In other words, the connection detector 133 has its forward movement towards the detecting position DP prevented.

The projecting end 142 of the resilient piece 137 is placed on the outer surface of the lock 126, and the cut-away portion 144 is fit obliquely to the lock 126 from an upper rear side. In this state, the support 136 is held vertically between the lower plate 129 and the coupling 127, and the coupling 127 is held vertically between the support 136 and the restriction 138. Thus, the connection detector 133 cannot move vertically relative to the lock arm 124.

The support 136 is held between the arms 125 and the left and right side walls 134 are held in contact with the left and right inner wall surfaces of the tubular fitting 123. Thus, the connection detector 133 is prevented from moving laterally relative to the lock arm 124 and the second housing 120. Further, with the connection detector 133 at the initial position SP, the upper surface of the restriction 138 is at substantially the same height as the upper surface of the upper wall 123A of the tubular fitting 123. Therefore, external matter will not collide with the restriction 138 from above.

The resilient piece 137 is displaced resiliently up to disengage the locks 141, 126. Thus, the connection detector 133 held at the initial position SP can be moved forward substantially parallel to the connecting direction of the housings 110, 120 while being guided by the guide grooves 139 and the guide ribs 130. Forward movement of the connection detector 133 is prevented when the bottom end of the touching portion 143 slides on the upper surface of the lock 126 and the front end of the restriction 138 contacts a front stop 123D on a front edge 123C of the tubular fitting 123. Simultaneously, the touching portion 143 passes the lock 126, the resilient piece 137 is restored resiliently and the touching portion 143 engages the lock 126 from the front. Thus, a backward movement of the connection detector 133 towards the initial position SP is prevented to hold the connection detector 133 at the detecting position DP.

The front ends of the side walls 134 contact the front edge 123C from the lower side when the connection detector 133 is at the detecting position DP. Thus, an upward displacement of the front end of the connection detector 133, i.e. a resilient displacement of the lock arm 124 to the unlocking posture, is prevented. External matter will not collide with the restriction 138 from above even with the connection detector 133 at the detection position DP, since the upper surface of the restriction 138 is at the same height as or slightly lower than the upper surface of the upper wall 123A of the tubular fitting 123

Figure 13:
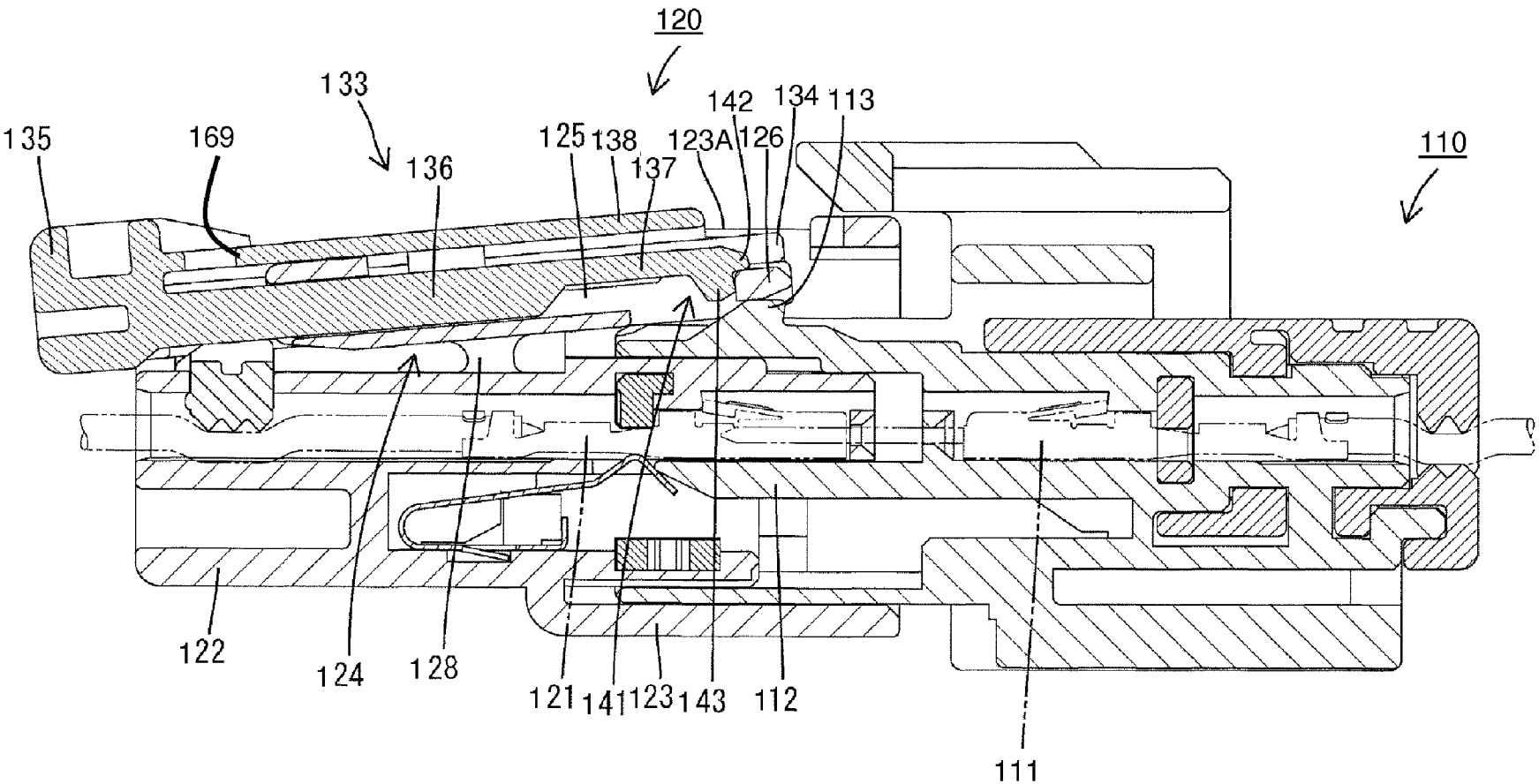
FIG. 13 is a vertical section showing a connecting process of two housings.

The receptacle 112 is fit on the terminal holding portion 122 and is inserted into the tubular fitting 123 in the process of connecting the two housings 110, 120. Then, as shown in FIG. 13, the lock 126 moves onto the lock projection 113. Accordingly, the lock arm 124 is displaced resiliently to the unlocking posture. At this time, the connection detector 133 also inclines its posture to displace the front end side thereof up while being united with the lock arm 124. However, the lock 141 is held engaged with the lock 126, and the connection detector 133 cannot move to the detecting position DP.

Figure 14:
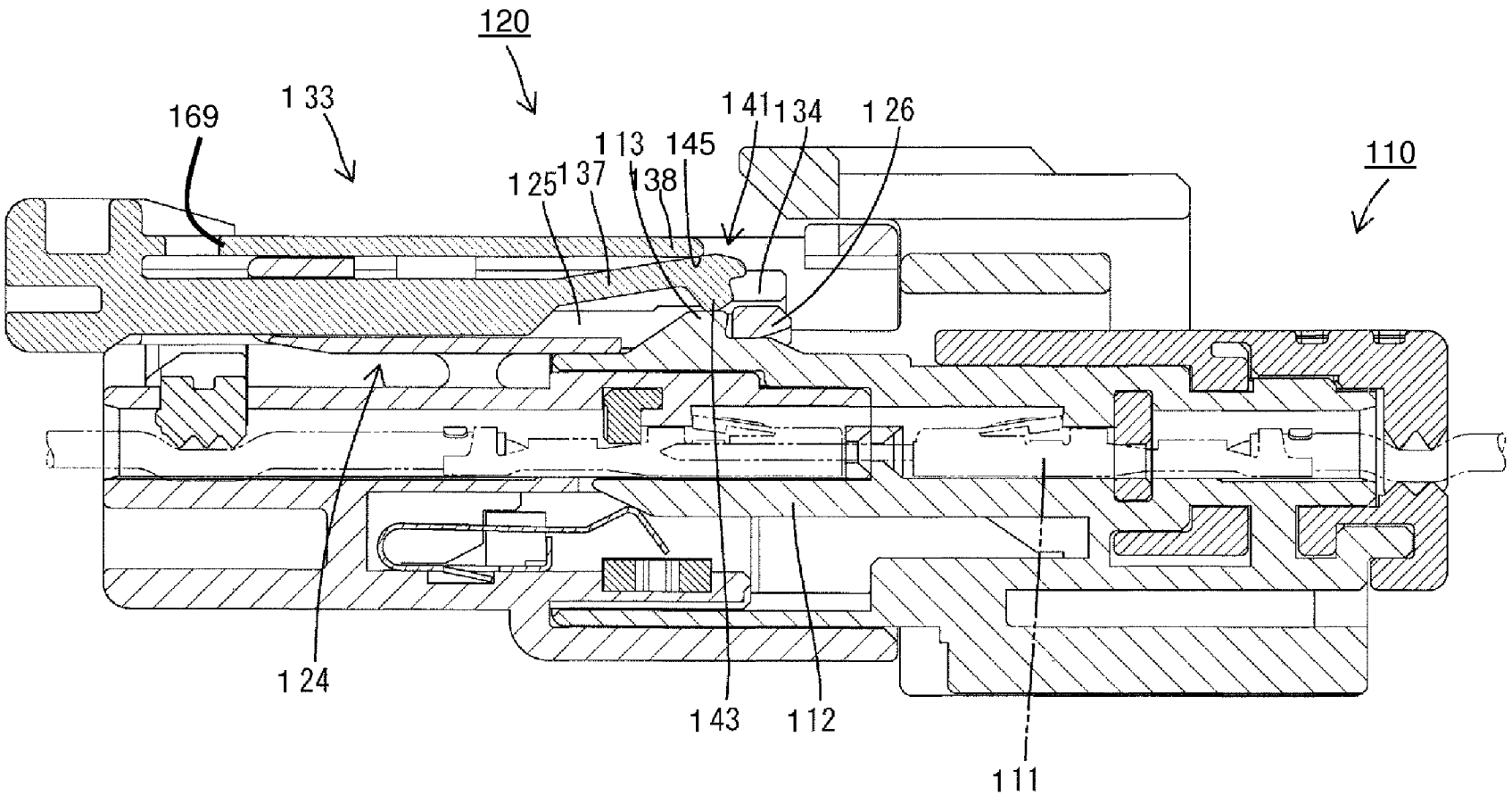
FIG. 14 is a vertical section showing a state where the two housings are properly connected and the connection detector is at the initial position.

The lock 126 passes the lock projection 113 as the connecting operation of the housings 110, 120 proceeds and the two housings 110, 120 become connected properly as shown in FIG. 14. The lock arm 124 then is restored resiliently to the locking posture so that the engagement of the lock 126 and the lock projection 113 locks the housings 110, 120 together. A part of the connection detector 133 except the resilient piece 137 is returned to its original posture together with the lock arm 124 when the lock arm 124 is restored resiliently. At this time, the lock projection 113 is located under the lock 141 of the resilient piece 137. Thus, the resilient piece 137 is displaced resiliently up relative to the side walls 134 and the restriction 138, and the touching portion 143 is placed on the upper surface of the lock projection 113.

The contact 145 at the front end of the restriction 138 may collide with the upper surface of the lock 141 from above when the lock arm 124 is restored resiliently together with the connection detector 133. This collision is at a part of the lock 141 in forward and backward directions where the thickness is largest and where the touching portion 143 is formed. Thus, the portion of the lock 141 between the restriction 138 and the lock 113 will not deform.

The locks 141 and 126 are disengaged from each other by an upward movement of the touching portion 143 relative to the lock 126 in the state where the two housings 110, 120 are connected properly and the connection detector 133 is at the initial position SP. Thus, the connection detector 133 is permitted to move forward. Further, the upper surface of the lock 113 in contact with the lock 141 and the upper surface of the lock 126 are at substantially the same height so as to be substantially flush with each other. Thus, the lock 141 can slide to move from the outer surface of the lock 113 onto that of the lock 126. In other words, the connection detector 133 can slide from the initial position SP to the detecting position DP.

Figure 15:
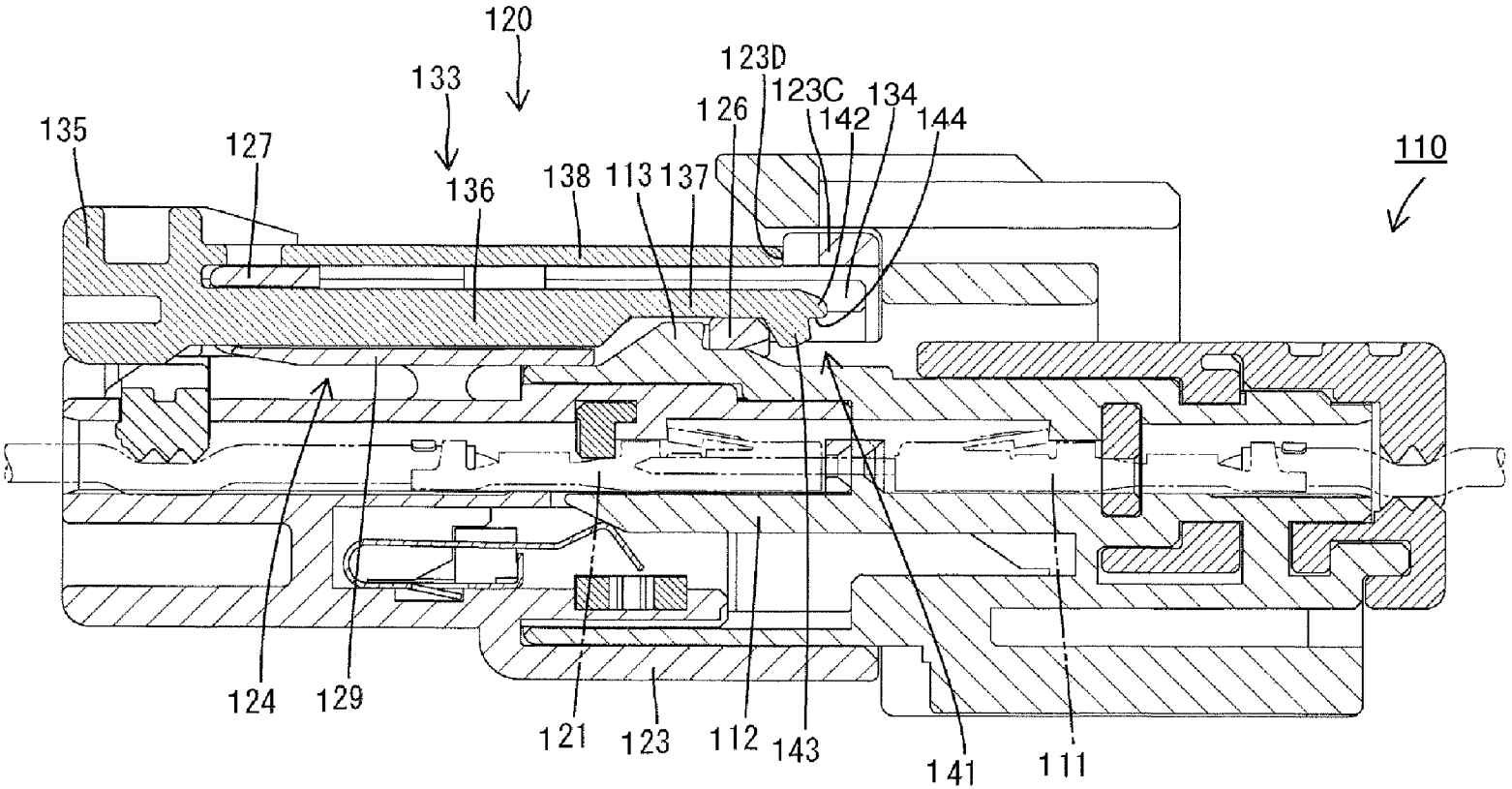
FIG. 15 is a vertical section showing a state where the two housings are properly connected and the connection detector is at a detection position.

The touching portion 143 passes the lock 126, as shown in FIG. 15, if the operable portion 135 is pushed from behind in this state to move the connection detector 133 to the detecting position DP. Therefore the resilient piece 137 is restored resiliently and the touching portion 143 is engaged with the lock 126 from the front. This engagement prevents a backward returning movement of the connection detector 133 towards the initial position SP and holds the connection detector 133 at the detecting position DP.

Figure 11:
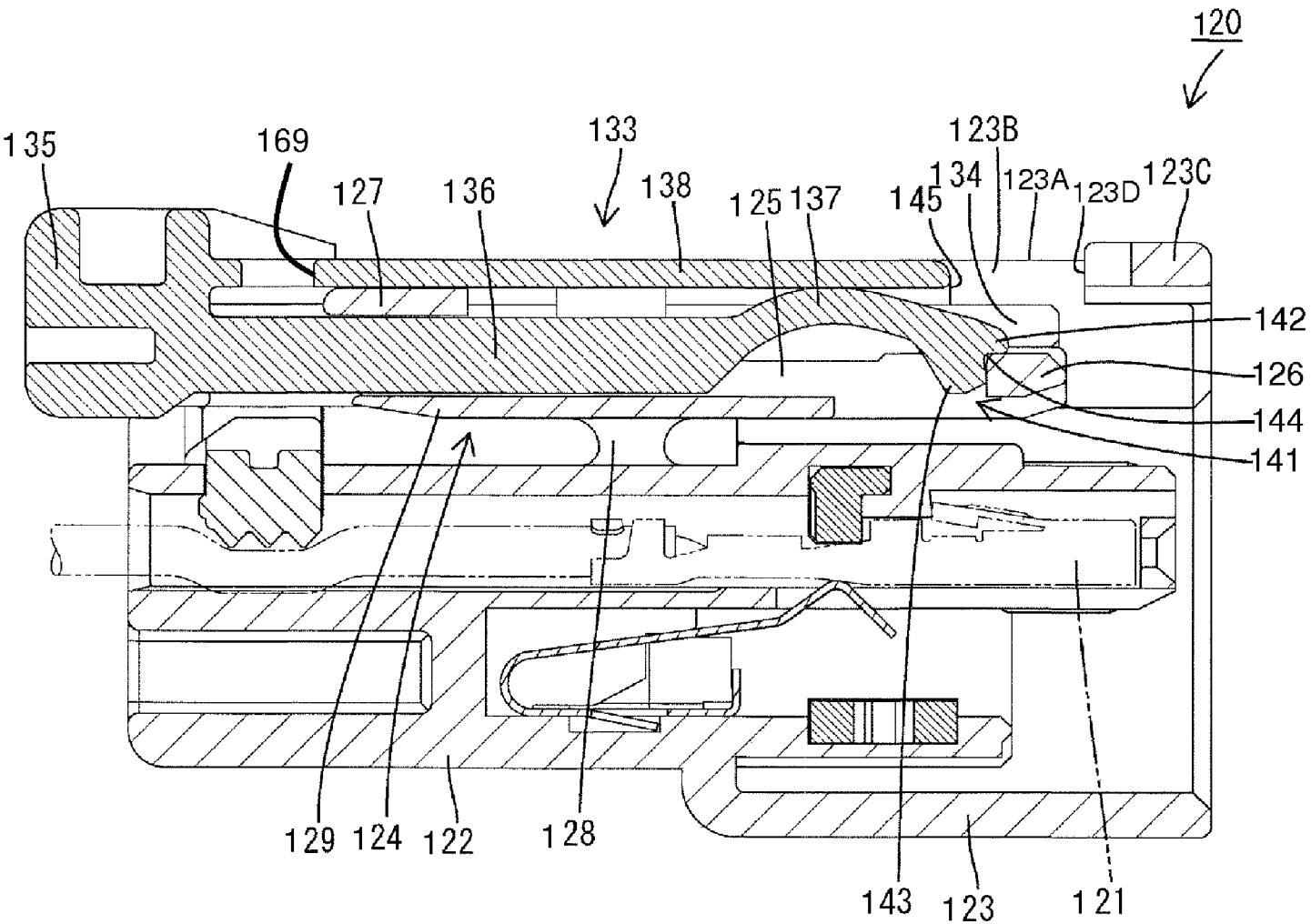
FIG. 11 is a vertical section of a second embodiment showing a state where a restriction prevents excessive curved deformation of a resilient piece.
Figure 12:
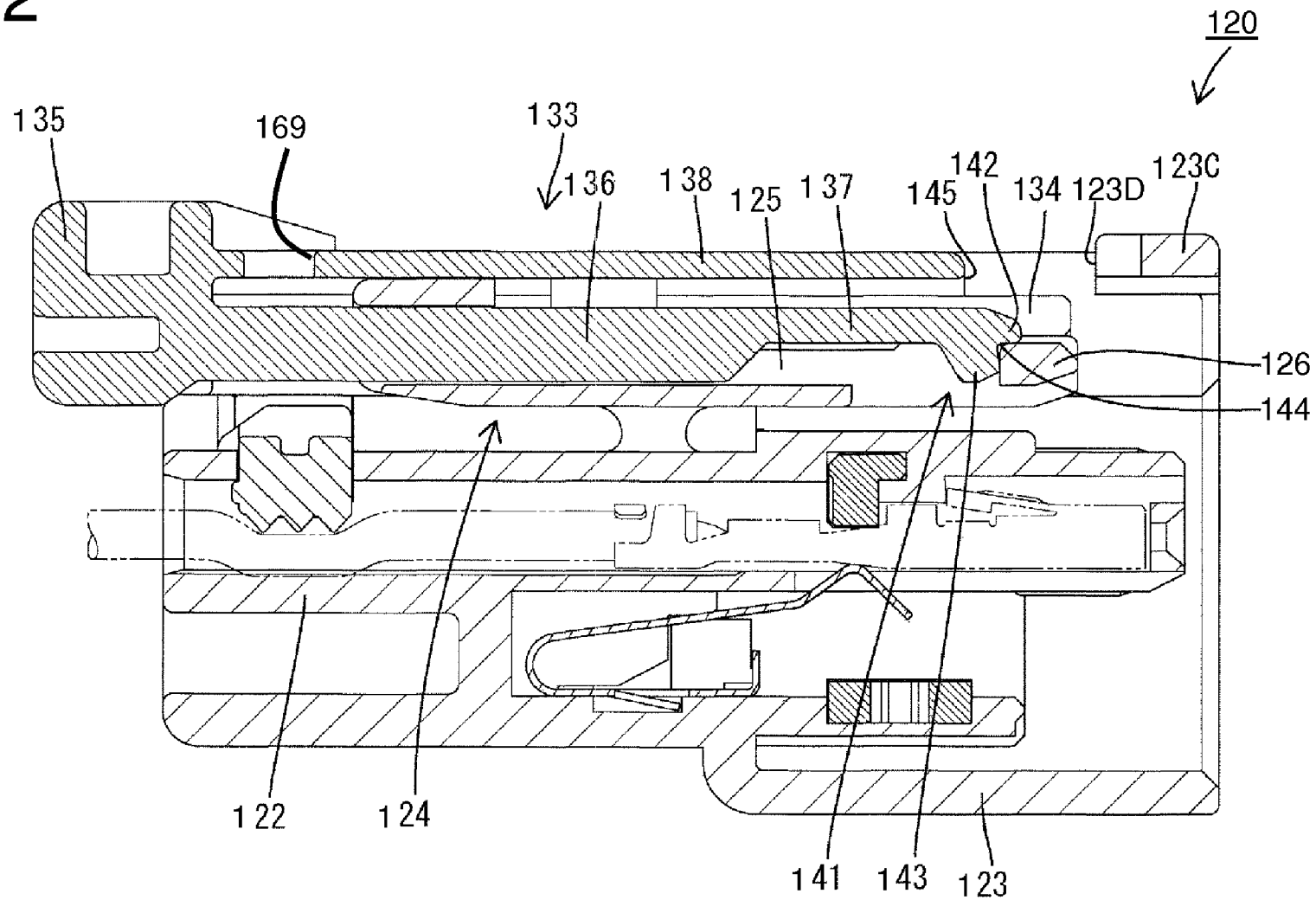
FIG. 12 is a vertical section of a second housing with a connection detector located at an initial position.

The connection detector 133 cannot be moved from the initial position SP to the detecting position DP if the two housings 110, 120 are not connected yet. Specifically, a strong pushing force could be exerted on the operable portion 135 from behind while the connection detector 133 is at the initial position SP. This pushing force will cause the resilient piece 137 to deform resiliently and will curve the part of the resilient piece 137 between the base end and the lock 141 up as shown in FIG. 11. If this resilient deformation amount increases, a forward inclined angle of the front end of the resilient piece 127 increases. Thus, the front end of the projecting end 142 could contact the upper surface of the lock 126 to displace the touching portion 143 up relative to the lock 126 and, consequently, the touching portion 143 could disengage from the lock 126. Then, the lock 141 of the resilient piece 137 would no longer prevent a forward movement of the connection detector 133, and the connection detector 133 could move to the detecting position DP.

However, in this embodiment, the restriction 138 is provided above the resilient piece 137 and prevents an excessive curved deformation of the resilient piece 137. Thus, even if a curved deformation amount of the resilient piece 137 is maximized, the lock 141 is held engaged with the lock 126 to prevent a forward movement of the connection detector 133. In this way, the connection detector 133 cannot move to the detecting position when the two housings 110, 120 are not connected yet.

The lengthwise intermediate part of the resilient piece 137 is displaced maximally when the resilient piece 137 is curved. Thus, the restriction 138 is formed over the range including the area corresponding to the lengthwise intermediate part of the resilient piece 137. Therefore, the excessive curved deformation of the resilient piece 137 is prevented effectively.

The connection detector 133 still is at the initial position SP when the housings 110, 120 become properly connected. Thus, the resilient piece 137 interferes with the lock projection 113, inclines its posture and displaces towards the restriction 138. A displacement amount of the resilient piece 137 at this time is largest at the extending front end of the resilient piece 137. As a result, the formation range of the restricting portion 138 excludes the extending end. Therefore, there is no likelihood of hindering the displacement of the resilient piece 137 due to the interference of the extending end of the resilient piece 137 with the restriction 138.

The extending front end of the resilient piece 137 contacts the contact 145 at the front end edge of the restriction 138 as the resilient piece 137 is displaced. The contact portion 145 and the resilient piece 137 may be deformed if this contact 145 is an angular edge. However, the contact 145 is arcuate in this embodiment to prevent deformations of the contact 145 and the resilient piece 137.

The restriction 138 is unitary to the connection detector 133 as a base of the resilient piece 137. Thus, there is no likelihood of disrupting the positional relationship of the resilient piece 137 and the restriction 138.

The restriction 138 is connected with the upper edges of the side walls 134 at substantially right angles. Thus, the deflection strength of the restriction 138 is higher as compared with a restriction formed as a single plate. Therefore, curved deformation of the resilient piece 137 is restricted reliably.

The invention is not limited to the above described and illustrated embodiment. For example, the following embodiments are also embraced by the technical scope of the present invention.

Although the restriction is formed on the connection detector in the above embodiment, it may be formed in the second housing.

Although the restriction is formed not to correspond to the extending end of the resilient piece in the above embodiment, it may correspond to the extending end of the resilient piece.

The restriction is in the lengthwise middle part of the resilient piece in the above embodiment. However, the restriction need not be in the lengthwise middle part of the resilient piece. In this case, a part of the resilient piece other than the middle part maximally displaced upon the curved deformation of the resilient piece contacts the restriction.

The restriction is reinforced by being connected with the walls in the above embodiment. However, it may be a single cantilevered plate according.

The restriction is plate-like in the above embodiment, but it may be a block with a large thickness in the deforming direction of the resilient piece.

Although the contact is arcuate in the above embodiment, it may be a tapered or angular edge according to the invention.

In the above embodiment, the connection detector is mounted slidably on the lock arm and is inclined together with the lock arm. However, the invention is also applicable to connectors in which a connection detector is not mounted on a lock arm, but slidably supported on a part of a second housing other than the lock arm.

What is claimed is:

1. A connector, comprising:

a housing with opposite front and rear ends spaced apart along a connecting direction, the housing including a lock arm that is resiliently deflectable in directions intersecting the connecting direction; and a connection detector slidably mounted on the lock arm for movement between an initial position and a detection position in directions substantially parallel to the connecting direction, a resilient piece formed on the connection detector and extending in a direction towards the detection position, the resilient piece having a lock engageable with the lock arm to prevent a sliding movement of the connection detector to the detection position, the resilient piece being deflectable for disengaging the lock from the lock arm to permit movement of the connection detector to the detection position, and a restriction formed on the connection detector to limit a curved deformation of the resilient piece while the lock is engaged with the lock arm for resisting movement of the connection detector to the detection position while the lock is contacting the lock arm.

2. The connector of claim 1, wherein the restriction is formed in a range corresponding to at least a lengthwise middle part of the resilient piece along a curvable area of the resilient piece from a base end thereof to the lock that is engageable with the lock arm.

3. The connector of claim 1, wherein the resilient piece is cantilevered and has a base end and an extending end, the restriction being spaced rearward from the extending end of the resilient piece to permit resilient deformation of the resilient piece about the base end for disengaging the lock from the lock arm.

4. The connector of claim 3, wherein a tapered contact is formed at an end edge of the restriction at the same side as the extending end of the resilient piece.

5. The connector of claim 1, wherein the restriction is unitary with the connection detector.

6. The connector of claim 5, wherein the connection detector includes two side walls at opposite sides of the resilient piece, and the restriction is connected with edges of the side walls substantially at right angles.

7. A connector assembly, comprising:

a first connector formed with a lock;

a second connector connectable with the first connector along a connecting direction, the second connector being formed with a resiliently deflectable lock arm configured for locked engagement with the lock when the connectors are connected properly; and a connection detector mounted on the lock arm for movement with the lock arm as the lock arm deflects, the connection detector being slidable along the lock arm from an initial position to a detection position, a resilient piece cantilevered forward on the connection detector and towards the detection position, the resilient piece contacting the lock arm to prevent movement of the connection detector to the detection position before the lock arm is in locked engagement with the lock of the first connector, the resilient piece deflecting free of the lock arm to permit movement of the connection detector to the detection position after the lock arm is in locked engagement with the lock, and a restriction formed on the connection detector and disposed to limit curved deformation of the resilient piece when the connection detector is at the initial position.

8. The connector assembly of claim 7, wherein the lock arm is deformable in a direction intersecting the connecting direction of the housings by interference with the lock of the first housing while connecting the housings, the lock arm passes the lock when the housings are connected properly and restores resiliently to engage the lock and to prevent separation of the housings, and the resilient piece disengages from the lock arm by interference with the lock so that the connection detector is moveable to the detection position.

9. The connector assembly of claim 7, wherein the resilient piece has a lock for contacting the lock arm to prevent movement of the connection detector to the detection position, the restriction being formed in a range corresponding to at least a lengthwise middle part of the resilient piece along a curvable area of the resilient piece from a base end thereof to the lock that is engageable with the lock arm.

10. The connector assembly of claim 9, wherein the resilient piece has an extending end remote from the base end, the restriction being spaced rearward from the extending end of the resilient piece to permit resilient deformation of the resilient piece about the base end for disengaging the lock from the lock arm.

11. The connector assembly of claim 10, wherein a tapered contact is formed at an end edge of the restriction at the same side as the extending end of the resilient piece.

12. The connector assembly of claim 7, wherein the restriction is unitary with the connection detector.

13. The connector assembly of claim 12, wherein the connection detector includes two side walls at opposite sides of the resilient piece, and the restriction is connected with edges of the side walls substantially at right angles.

14. A connector, comprising:

a housing capable of accommodating at least one terminal fitting, at least one detector assembled with the housing and being movable on the housing between a standby position and a detection position, the detector being permitted to move from the standby position to the detection position if the housing is properly connected with a mating housing and being prevented from moving to the detection position in a state where the housing is partly connected with the mating housing, the detector being formed with at least one opening and having a corresponding part opposed to and spaced from the opening so that the corresponding part can be seen through the opening when the detector is at the standby position and, the housing having a surface that moves into the space between the opening of the detector and the corresponding part of the detector when the detector is at the detection position, and the housing being of a first color and the detector being of a second color different than the first color, the second color of the corresponding part of the detector being visible at the opening in the detector when the detector is at the standby position and the first color of the housing being visible at the opening in the detector when the detector is at the detection position.

15. The connector of claim 14, wherein the housing includes at least one lock arm for holding a connected state with the mating housing, and the corresponding part of the housing that can be seen through the opening when the detector at the detection position.

* * * * *